US010191447B2

(12) United States Patent
Yamamoto

(10) Patent No.: US 10,191,447 B2
(45) Date of Patent: Jan. 29, 2019

(54) IMAGE FORMING APPARATUS WITH CONTROL PART THAT CORRECTS POTENTIAL DIFFERENCE BASED ON TEMPERATURE DIFFERENCE

(71) Applicant: Oki Data Corporation, Tokyo (JP)

(72) Inventor: Susumu Yamamoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/655,230

(22) Filed: Jul. 20, 2017

(65) Prior Publication Data

US 2018/0032029 A1 Feb. 1, 2018

(30) Foreign Application Priority Data

Jul. 28, 2016 (JP) ..... 2016-148658

(51) Int. Cl.

| | |
|---|---|
| ***G03G 21/20*** | (2006.01) |
| ***G03G 15/06*** | (2006.01) |
| ***G03G 15/08*** | (2006.01) |
| ***G03G 15/01*** | (2006.01) |

(52) U.S. Cl.

CPC ..... *G03G 21/203* (2013.01); *G03G 15/065* (2013.01); *G03G 15/0808* (2013.01); *G03G 15/0121* (2013.01); *G03G 15/0818* (2013.01)

(58) Field of Classification Search

CPC ..... G03G 21/203; G03G 15/065; G03G 15/0808; G03G 15/0121; G03G 15/0818; G03G 21/20

See application file for complete search history.

(56) References Cited

U.S. PATENT DOCUMENTS

2012/0063817 A1* 3/2012 Matsuzaki ..... G03G 15/0808 399/281
2016/0209774 A1* 7/2016 Abe ..... G03G 15/065

FOREIGN PATENT DOCUMENTS

JP 2009-199010 A 9/2009

* cited by examiner

*Primary Examiner* — Sandra Brase
(74) *Attorney, Agent, or Firm* — Muncy, Geissler, Olds & Lowe, P.C.

(57) ABSTRACT

An image forming apparatus includes a development part, a temperature detection part that detects an apparatus inner temperature, and a control part that corrects a potential difference (ΔV) between the development voltage and the supply voltage based on a temperature difference (ΔT). The potential difference is an absolute value determined by follow:

$\Delta V$=|(the development voltage)−(the supply voltage).| the temperature difference is determined by follow:

$\Delta T$=(the apparatus inner temperature)−(a glass transition starting temperature).

The glass transition starting temperature is determined in consideration of a differential scanning calorimetry (DSC) curve of the toner.

16 Claims, 19 Drawing Sheets

| TAB1 | Temp. Difference ΔT (°C) | | | | | | |
|---|---|---|---|---|---|---|---|
| | ≦0 | 1 | 2 | 3 | 4 | 5 | 6 |
| K | 2 | 5 | 10 | 15 | 20 | 25 | 30 |
| C | 2 | 5 | 10 | 15 | 20 | 25 | 30 |
| M | 2 | 5 | 10 | 15 | 20 | 25 | 30 |
| Y | 2 | 5 | 10 | 15 | 20 | 25 | 30 |

| TAB2 | Frequency F (No. of Times) | | | | |
|---|---|---|---|---|---|
| | ~50 | ~100 | ~150 | ~200 | >200 |
| K | 0.5 | 0.7 | 0.8 | 1.0 | 1.0 |
| C | 0.5 | 0.7 | 0.8 | 1.0 | 1.0 |
| M | 0.5 | 0.7 | 0.8 | 1.0 | 1.0 |
| Y | 0.5 | 0.7 | 0.8 | 1.0 | 1.0 |

○: Forming Speed 1
200 times / 30 min.

△: Forming Speed 2
50 times / 30 min.

*Fig. 18*

| TAB3 | Print Rate R (%) | | | | | | | | | |
|---|---|---|---|---|---|---|---|---|---|---|
| | ~1 | ~3 | ~5 | ~10 | ~20 | ~30 | ~50 | ~70 | ~85 | ~100 |
| K | 1.0 | 1.0 | 0.9 | 0.8 | 0.7 | 0.6 | 0.5 | 0.5 | 0.5 | 0.5 |
| C | 1.0 | 1.0 | 0.9 | 0.8 | 0.7 | 0.6 | 0.5 | 0.5 | 0.5 | 0.5 |
| M | 1.0 | 1.0 | 0.9 | 0.8 | 0.7 | 0.6 | 0.5 | 0.5 | 0.5 | 0.5 |
| Y | 1.0 | 1.0 | 0.9 | 0.8 | 0.7 | 0.6 | 0.5 | 0.5 | 0.5 | 0.5 |

IMAGE FORMING APPARATUS WITH CONTROL PART THAT CORRECTS POTENTIAL DIFFERENCE BASED ON TEMPERATURE DIFFERENCE

CROSS REFERENCE TO RELATED APPLICATIONS

This application claims priority under 35 USC 119 to Japanese Patent Application No. 2016-148658 filed on Jul. 28, 2016 original document, the entire contents which are incorporated herein by reference.

TECHNOLOGY FIELD

The present invention relates to an image forming apparatus for forming an image using a developer carrier and a supply member for supplying toner to a surface of the developer carrier.

BACKGROUND

An image forming apparatus of an electrophotographic system has been widely spread. This is because, compared with an image forming apparatus of other systems such as an inkjet system, a clear image can be obtained in a short time.

The image forming apparatus of an electrographic system is provided with a development roller which is a developer carrier, a supply roller which is a supply member, and a photosensitive drum. In the image forming process, first, toner is supplied from the surface of the supply roller to the surface of the development roller. Subsequently, after an electrostatic latent image is formed on the surface of the photosensitive drum, the toner is transferred from the surface of the development roller to the surface of the photosensitive drum, so that the toner adheres to the electrostatic latent image. Finally, after the toner adhered to the electrostatic latent image is transferred to the medium, the toner is fixed to the medium.

Regarding the configuration of the image forming apparatus, various proposals have already been made. Specifically, in order to improve the image quality, when the temperature in the apparatus has reached a predetermined threshold value or higher, the difference between the voltage applied to the development roller and the voltage applied to the supply roller is corrected (See, for example, Patent Document 1).

RELATED ART

Patent Document

[Patent Doc. 1] JP Laid-Open Patent Publication 2009-199010

Conventionally, studies to resolve a drawback that is caused by a difference between voltages, one voltage being applied to a development roller and the other voltage being applied to a supply roller, have been made. However, these solutions have not been regarded enough. Rooms to improve remain.

The invention is made for the drawback. One of the subjects of the invention is to provide an image forming apparatus that is able to stably produce a high quality image.

SUMMARY

An image forming apparatus disclosed in the application comprises a development part that includes a developer carrier to which a development voltage (V1) is applied and a supply member to which a supply voltage (V2) is applied, the supply member supplying toner on a surface of the developer carrier; a temperature detection part that detects an apparatus inner temperature that is measured inside or near the developer carrier; and a control part that corrects a potential difference (ΔV) between the development voltage and the supply voltage based on a temperature difference (ΔT) The potential difference is an absolute value determined by follow:

$$\Delta V = |(\text{the development voltage}) - (\text{the supply voltage})|$$

the temperature difference is determined by follow:

$$\Delta T = (\text{the apparatus inner temperature}) - (\text{a glass transition starting temperature}),$$

<Glass Transition Starting Temperature>

The glass transition starting temperature is defined as a temperature corresponding to an intersection between a base line and a glass transition start judgment tangent line, which are specified based on a differential curve of a differential scanning calorimetry (DSC) curve of the toner measured using a DSC method, herein the horizontal axis of the DSC curve: temperature (° C.), the vertical axis of the DSC curve: calorific differential value (?W/° C.), the base line is a line along an initial section of the DSC curve in which the calorific differential value is approximately constant with respect to the calorific differential value, the glass transition start judgment tangent line is a tangent line which is in contact with the differential curve at an intersection between the differential curve and a glass transition start judgment line that is a line of which the calorific differential values are 1.5 times greater than those of the base line.

The "glass transition starting temperature" is, as apparent from the above definition, a temperature that is determined from the differential curve of the DSC curve, a unique parameter of the invention and to be set lower than an actual glass transition temperature of toner. Specific protocol to determine the glass transition starting temperature is discussed later. In the invention, the apparatus inner temperature may be measured somewhere from toner cartridges (or containers) to a photosensitive drum. The temperature may be measured inside these sections or in the vicinity of these sections. More specifically, the temperature may be measured at or in the vicinity of the photosensitive drum. Also, a temperature of a transfer belt that is in contact with the photosensitive drum is useful for the apparatus inner temperature.

With an embodiment of the image forming apparatus disclosed in the application, the potential difference ΔT is corrected based on the temperature difference ΔT that is a gap between the apparatus inner temperature and the glass transition starting temperature. Therefore, a high quality image can be stably obtained.

BRIEF DESCRIPTION OF THE DRAWINGS

FIG. 18 is a view showing table data used for determining a correction coefficient (print rate coefficient C3) based on print rate R.

DETAILED EXPLANATIONS OF THE PREFERRED EMBODIMENT(S)

Hereinafter, an embodiment of the present invention will be described in detail with reference to the drawings. The order of description is as follows.

1. Image Forming Apparatus (1st Embodiment)
  1-1. Overall Structure
  1-2. Structure of Developing Part
  1-3. Block Configuration
  1-4. Specifying Procedure of Glass Transition Starting Temperature
  1-5. Toner Composition
  1-6. Operation
  1-7. Functions and Effects
2. Image Forming Apparatus (2nd Embodiment)
  2-1. Structure
  2-2. Operation
  2-3. Functions and Effects
3. Image Forming Apparatus (3rd Embodiment)
  3-1. Structure
  3-2. Operation
  3-3. Functions and Effects
4. Modified Example <Image Forming Apparatus>

An image forming apparatus of one embodiment according to the present invention will be described.

<1-1. Overall Structure>

First, the overall structure of the image forming apparatus will be described.

The image forming apparatus described here is, for example, a full color printer of an electrophotographic system, and forms an image on a surface of a medium M (see later-described FIG. 1) using toner (so-called developer). The material of the medium M is not particularly limited, but it is, for example, one type or two or more types of a paper, a film, etc.

Figure 1:
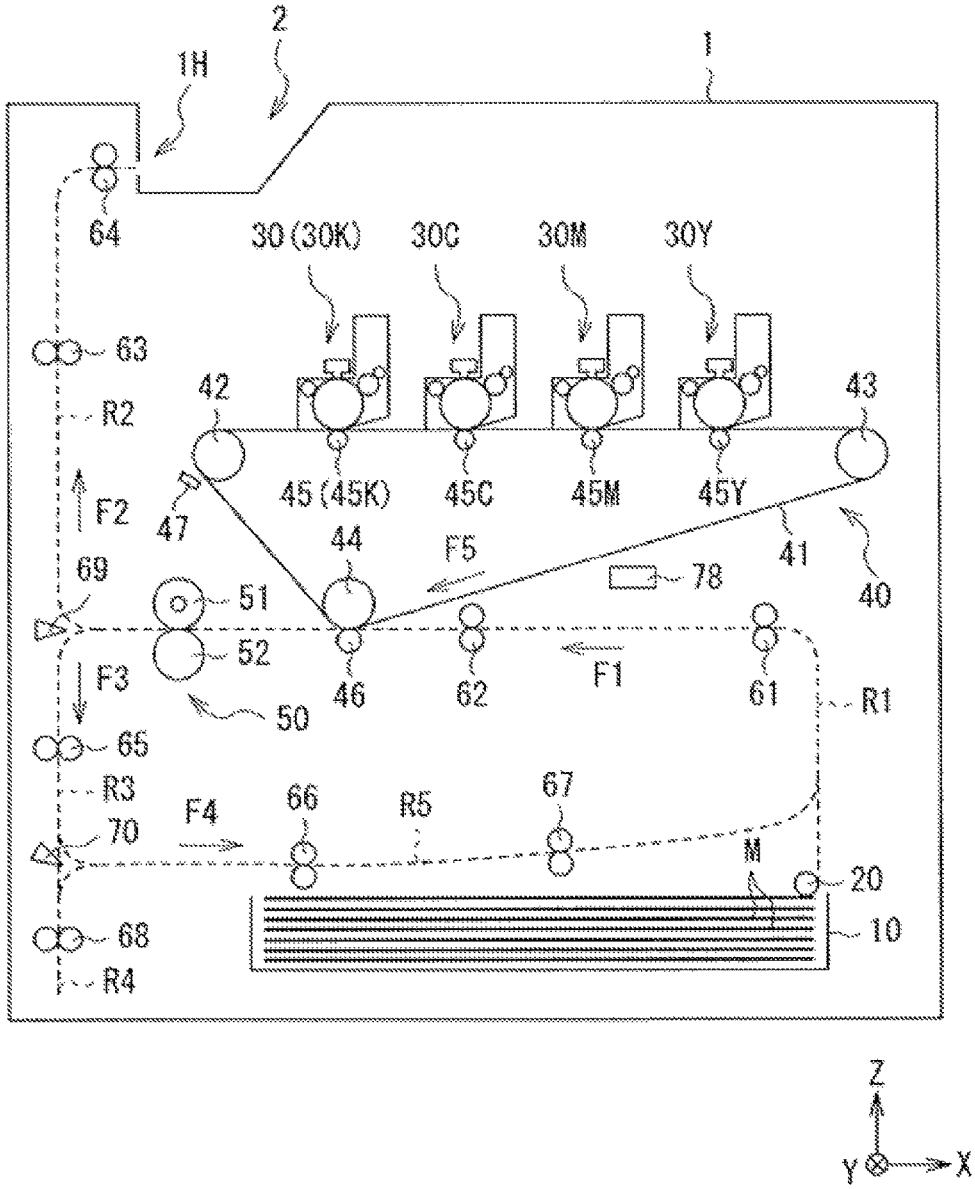
FIG. 1 is a plan view showing a configuration of an image forming apparatus according to an embodiment of the present invention.

FIG. 1 shows a planar configuration of the image forming apparatus. In this image forming apparatus, the medium M can be carried along the carrying paths R1 to R5. In FIG. 1, each of the carrying paths R1 to R5 is indicated by a broken line.

For example, as shown in FIG. 1, inside the housing 1, the image forming apparatus is provided with a tray 10, a feed roller 20, one or two or more developing parts 30 which is the "image forming unit" according to an embodiment of the present invention, a transfer part 40, a fuser 50, carrying roller 61 to 68, carrying path switching guides 69 and 70, and a temperature sensor 78 which is the "temperature detecting part" of one embodiment of the present invention.

[Housing]

The housing 1 includes one or two or more types of, for example, a metal material and a polymeric material. The housing 1 is provided with a stacker part 2 for discharging the medium M on which an image is formed, and the medium M on which the image is formed is discharged from an ejection opening 1H provided in the housing 1.

[Tray and Feed Roller]

The tray 10 is, for example, removably installed in the housing 1 and contains mediums M. For example, the feed roller 20 extends in the Y axis direction and is rotatable about the Y axis. Among a series of constituent elements described below, constituent elements including the term "roller" in the name are extended in the Y-axis direction and rotatable about the Y-axis in the same manner as in the feed roller 20.

In this tray 10, for example, a plurality of mediums M is contained in a stacked state. The plurality of mediums M contained in the tray 10, for example, is taken out one by one from the tray 10 by the feed roller 20.

The number of trays 10 and the number of feed rollers 20 are not particularly limited, and may be one or two or more.

In FIG. 1, for example, it shows the case in which the number of trays 10 is one and the number of feed rollers 20 is one.

[Developing Part]

The developing part 30 performs a forming process (development process) of a toner image using toner. Specifically, the developing part 30 primarily forms a latent image (electrostatic latent image) and a toner image by making the toner adhere to the electrostatic latent image using a Coulomb force.

Here, the image forming apparatus is equipped with, for example, four developing parts 30 (30K, 30C, 30M, and 30Y).

Each of the developing parts 30K, 30C, 30M, and 30Y is installed, for example, removably with respect to the housing 1, and arranged along the movement path of the intermediate transfer belt 41, which will be described later. Here, the developing parts 30K, 30C, 30M, and 30Y are arranged, for example, in this order from the upstream side to the downstream side in the moving direction (F5) of the intermediate transfer belt 41.

Each of the developing parts 30K, 30C, 30M, and 30Y has the same structure except that, for example, the type (color) of toner contained in the cartridge 39 (see FIG. 2) is different. The respective developing parts 30K, 30C, 30M, and 30Y will be described later.

[Transfer Part]

The transfer part 40 performs a transfer process of a toner image to which a development process was performed by the developing part 30. Specifically, the transfer part 40 mainly transfers the toner image formed by the developing part 30 to the medium M.

The transfer part 40 includes, for example, an intermediate transfer belt 41, a drive roller 42, a driven roller (idler roller) 43, a backup roller 44, one or two or more primary transfer rollers 45, a secondary transfer roller 46, and a cleaning blade 47.

The intermediate transfer belt 41 is a medium (intermediate transfer medium) to which the toner is temporarily transferred before the toner is transferred to the medium M, and is, for example, an endless elastic belt. The intermediate transfer belt 41 contains, for example, one or two or more types of polymer materials such as polyimide. The intermediate transfer belt 41 is movable in accordance with the rotation of the drive roller 42 in a state of being stretched by the drive roller 42, the driven roller 43, and the backup roller 44.

The drive roller 42 is, for example, rotatable using a driving force of a later-described roller motor 85 (see FIG. 3). Each of the driven roller 43 and the backup roller 44 is rotatable in accordance with the rotation of the drive roller 42.

The primary transfer roller 45 transfers (primarily transfers) the toner attached to the electrostatic latent image (toner image) to the intermediate transfer belt 41. This primary transfer roller 45 is press-contacted to the developing part 30 (later-described photosensitive drum 32: see FIG. 2) via the intermediate transfer belt 41. The primary transfer roller 45 is rotatable in accordance with the movement of the intermediate transfer belt 41.

Here, the transfer part 40 includes, for example, four primary transfer rollers 45 (45K, 45C, 45M, 45Y) corresponding to the aforementioned four developing parts 30 (30K, 30C, 30M, 30Y). The transfer part 40 includes one secondary transfer roller 46 corresponding to one backup roller 44.

The secondary transfer roller 46 transfers (secondly transfers) the toner transferred to the intermediate transfer belt 41 to the medium M.

This secondary transfer roller 46 is press-contacted to the backup roller 44 and includes, for example, a metallic core and an elastic layer such as a foamed rubber layer covering the outer peripheral surface of the core. The secondary transfer roller 46 is rotatable according to the movement of the intermediate transfer belt 41.

The cleaning blade 47 is press-contacted to the intermediate transfer belt 41 to scrape unnecessary developers remaining on the surface of the intermediate transfer belt 41.

[Fuser]

The fuser 50 performs a fusing process using the toner transferred to the medium M by the transfer part 40. Specifically, the fuser 50 fuses, for example, the toner to the medium M by pressurizing the toner transferred to the medium M by the transfer part 40 while heating.

The fuser 50 includes, for example, a heat application roller 51 and a pressure application roller 52.

The heat application roller 51 is configured to heat the toner. The heat application roller 51 includes, for example, a hollow cylindrical metal core and a resin coating covering the surface of the metal core. The metal core contains, for example, any one type or two or more types of metal materials such as, e.g., aluminum. The resin coating includes, for example, any one or two or more types of polymer materials such as a copolymer of tetrafluoroethylene and perfluoroalkyl vinyl ether (PFA) and polytetrafluoroethylene (PTFE).

Inside the heat application roller 51 (metal core), for example, a later-described heater 93 (see FIG. 3) is installed, and the heater 93 is, for example, a halogen lamp. In the vicinity of the heat application roller 51, a later-described thermistor 94 (see FIG. 3) is disposed at a position distant from the heat application roller 51. This thermistor 94 measures, for example, the surface temperature of the heat application roller 51.

The pressure application roller 52 is press-contacted to the heat application roller 51 and pressurizes the toner. This pressure application roller 52 is, for example, a metal rod, etc. This metal rod includes, for example, one type or two or more types of metal materials such as aluminum.

[Carrying Roller]

Each of the carrying rollers 61 to 68 includes a pair of rollers arranged so as to face each other via the carrying paths R1 to R5 of the medium M and carries the medium M taken out by the feed roller 20.

When an image is formed on only one side of the medium M, the medium M is carried, for example, by the carrying rollers 61 to 64 along the carrying paths R1 and R2. When images are formed on both sides of the medium M, the medium M is carried, for example, by the carrying rollers 61 to 68 along the carrying paths R1 to R5.

[Carrying Path Switching Guide]

The carrying path switching guides 69 and 70 change the carry direction of the medium M depending on the conditions of the manner of the image to be formed on the medium M (whether the image is formed on only one side of the medium M or the image is formed on both sides of the medium M).

[Temperature Sensor]

The temperature sensor 78 detects the temperature of the inside of the image forming apparatus (apparatus inner temperature T) in order to make it possible to carry out a correction operation of a potential difference $\Delta V$ which will be described later. The temperature sensor 78 includes, for example, one or two or more of a thermometer, a thermocouple, etc.

The apparatus inner temperature T is measured to judge the fluctuation of the toner adhesion amount (or the film thickness of the toner) due to the fluctuation of the potential difference ΔV, as will be described later. This is to shift the toner adhesion amount to an appropriate amount by correcting the potential difference ΔV in cases where the toner adhesion amount fluctuates due to the fluctuation of the potential difference ΔV.

Accordingly, the position of the temperature sensor 78 is not particularly limited as long as it is a position where the apparatus inner temperature T can be measured. Specifically, for example, the temperature sensor 78 may be provided in the developing part 30 itself to directly measure the temperature of the developing part 30 in which the toner is stored as the apparatus inner temperature T. Alternatively, for example, the temperature sensor 78 may be arranged around the developing part 30 to indirectly measure the temperature of the developing part 30 in which the toner is stored, as the apparatus inner temperature T.

Here, for example, the temperature sensor 78 is arranged in the vicinity of the intermediate transfer belt 41 to indirectly measure the temperature of the developing part 30 in which the toner is stored as the apparatus inner temperature T. In this case, the temperature sensor 78 measures, for example, the temperature of the transfer part 40 (intermediate transfer belt 41) as the apparatus inner temperature T.

<1-2. Structure of Developing Part>

Next, the configuration of the developing part 30 will be described.

Figure 2:
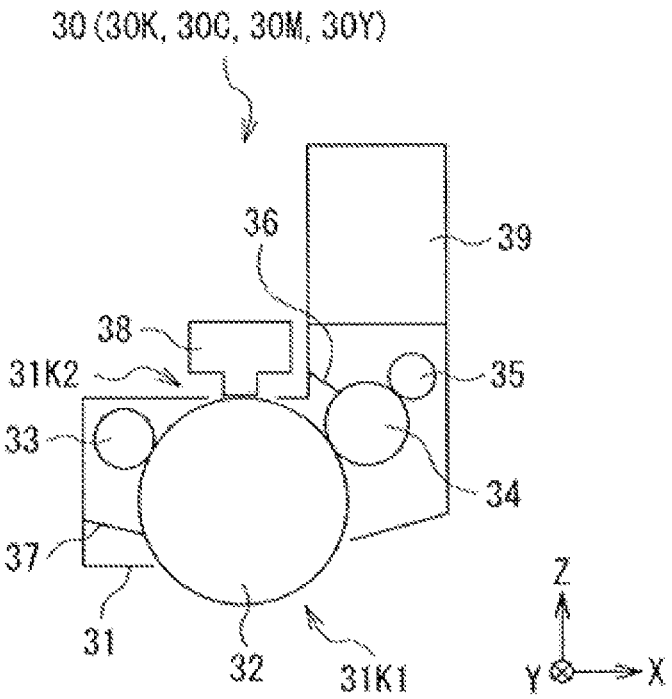
FIG. 2 is an enlarged plan view showing a configuration of a developing part shown in FIG. 1.

FIG. 2 is an enlarged planar configuration of the developing part 30 (30K, 30C, 30M, and 30Y) shown in FIG. 1.

As shown in FIG. 2, for example, each of the developing parts 30K, 30C, 30M, and 30Y includes, within the housing 31, a photosensitive drum 32 which is an "image carrier" according to an embodiment of the present invention, a charge roller 33, a development roller 34 which is a "developer carrier" according to one embodiment of the present invention, a supply roller 35, a development bladed 36, a cleaning blade 37, a light source 38. To this housing 31, for example, a cartridge 39 is detachably installed.

[Photosensitive Drum]

The photosensitive drum 32 is, for example, an organic-system photoreceptor including a cylindrical conductive supporting body and a photoconductive layer covering the outer peripheral surface of the conductive supporting body, and is rotatable via a driving source of a later-described drum motor 87 (see FIG. 3). The conductive supporting body is, for example, a metal pipe containing one or two or more types of metal materials such as aluminum. The photoconductive layer is a laminated body including, for example, a charge generation layer and a charge transportation layer. A part of the photosensitive drum 32 is exposed from the opening 31K1 provided in the housing 31.

The developing part 30 including the photosensitive drum 32 can move up and down as necessary. More specifically, for example, the developing part 30 moves downward at the time of forming an image until the photosensitive drum 32 comes into contact with the intermediate transfer belt 41. On the other hand, the developing part 30, for example, moves upward so that the photosensitive drum 32 is separated from the intermediate transfer belt 41 at the time of not forming an image.

[Charge Roller]

The charge roller 33 includes, for example, a metal shaft and a semiconductive epichlorohydrin rubber layer covering the outer peripheral surface of the metal shaft. This charge roller 33 is press-contacted to the photosensitive drum 32 in order to charge the photosensitive drum 32.

[Development Roller]

The development roller 34 includes, for example, a metal shaft and a semiconductive urethane rubber layer covering the outer peripheral surface of the metal shaft. This development roller 34 carries the toner supplied from the supply roller 35 and makes the toner adhere to the electrostatic latent image formed on the surface of the photosensitive drum 32.

[Supply Roller]

The supply roller 35 includes, for example, a metal shaft and a semiconductive foamed silicon sponge layer covering the outer peripheral surface of the metal shaft, and is a so-called sponge roller. This supply roller 35 supplies toner to the surface of the development roller 34 while sliding on the development roller 34.

[Development Blade]

The development blade 36 controls the thickness of the toner supplied to the surface of the development roller 34. For example, the development blade 36 is arranged at a position separated from the development roller 34 by a predetermined distance, and the thickness of the toner is controlled based on the distance (space) between the development roller 34 and the development blade 36. Further, the development bladed 36 contains, for example, one or two or more types of metallic materials such as stainless steel, etc.

[Cleaning Blade]

The cleaning blade 37 is configured to scrape unnecessary toner remaining on the surface of the photosensitive drum 32. This cleaning blade 37 extends, for example, in a direction substantially parallel to the extending direction of the photosensitive drum 32 and is in pressure contact with the photosensitive drum 32. Further, the cleaning blade 37 contains, for example, one or two or more types of polymeric materials such as, e.g., urethane rubber.

[Light Source]

The light source 38 is an exposure device for forming an electrostatic latent image on the surface of the photosensitive drum 32 by exposing the surface of the photosensitive drum 32 through the opening 31K2 provided in the housing 31. This light source 38 is, for example, a light emitting diode (LED) head, and includes an LED element, a lens array, etc. The LED element and the lens array are arranged so that the light (irradiated light) output from the LED element forms an image on the surface of the photosensitive drum 32.

[Cartridge]

The cartridge 39 contains toner. The type (color) of the toner stored in the cartridge 39 is, for example, as follows.

Here, for example, four types (four colors) of toner are used. Specifically, the cartridge 39 of the developing part 30K contains, for example, black toner. The cartridge 39 of the developing part 30C contains, for example, cyan toner. The cartridge 39 of the developing part 30M contains, for example, magenta toner. The cartridge 39 of the developing part 30Y contains, for example, yellow toner.

<1-3. Block Configuration>

Next, the block configuration of the image forming apparatus will be explained.

Figure 3:
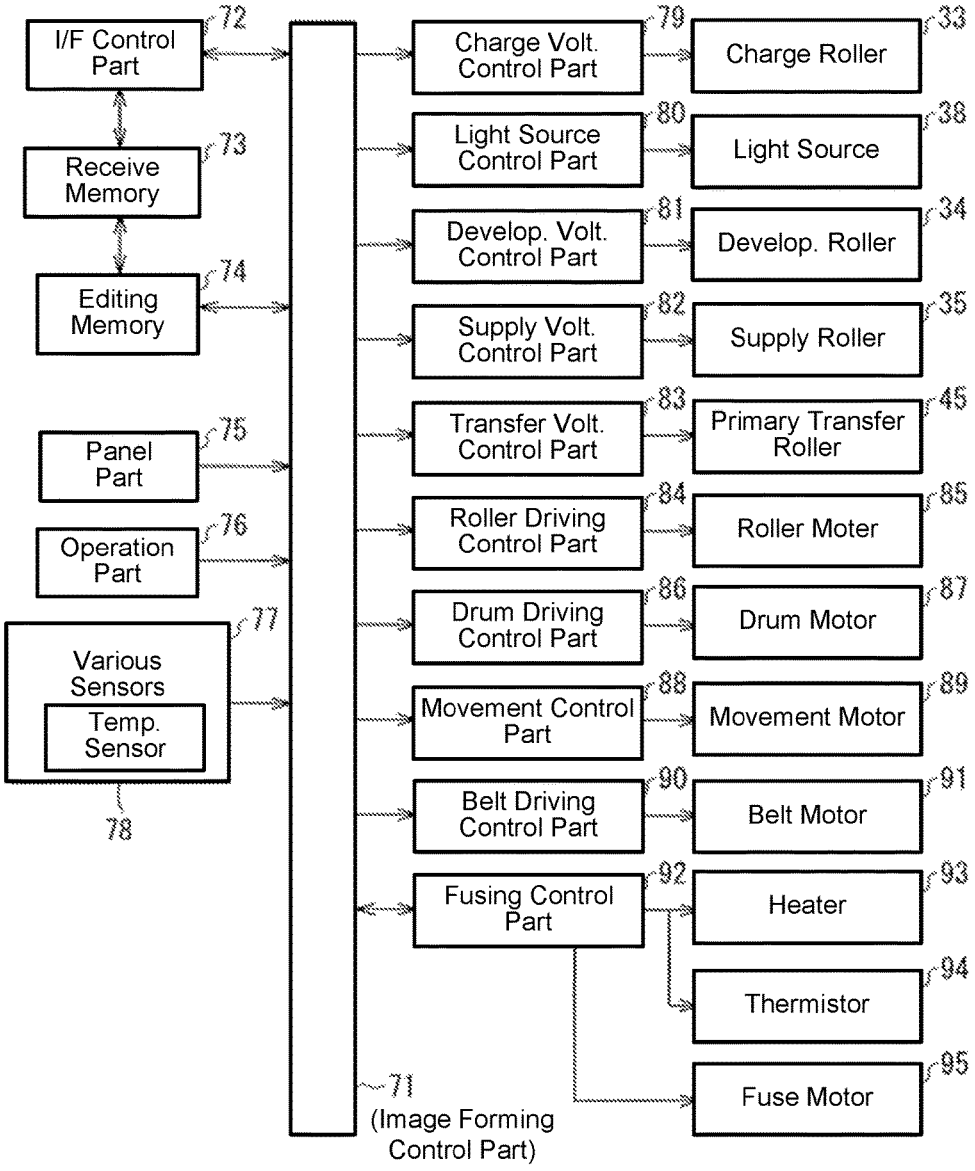
FIG. 3 is a block diagram showing a configuration of the image forming apparatus.
Figures 4, 5:
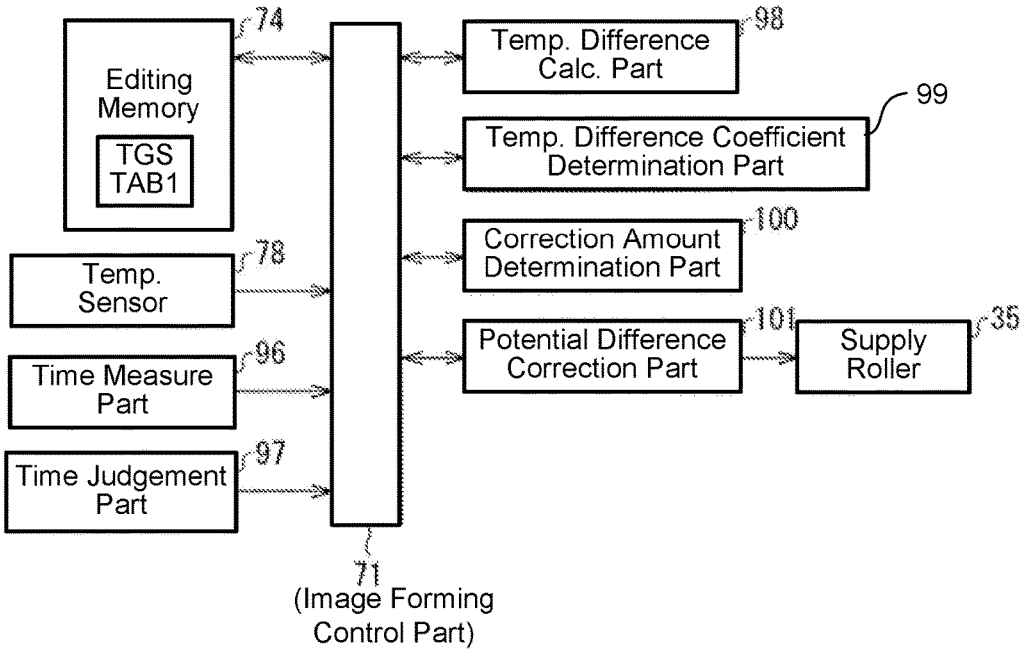
FIG. 4 is another block diagram showing a configuration of the image forming apparatus.
FIG. 5 is a table showing table data used for determining a correction coefficient (temperature difference coefficient C1) based on a temperature difference ΔT.

Each of FIG. 3 and FIG. 4 is a block diagram showing a configuration of the image forming apparatus. FIG. 3 shows main constituent elements with respect to image forming operations. FIG. 4 shows main constituent elements with respect to correction operations of the potential difference ΔV. It is noted that each of FIG. 3 and FIG. 4 illustrates parts of the main constituent elements discussed above. In FIG. 3 and FIG. 4, some parts of the constituent elements are overlapped.

FIG. 5 illustrates table data TAB1 used for determining a correction coefficient (temperature difference coefficient C1, which is the first correction coefficient) based on the temperature difference ΔT.

For example, as shown in FIG. 3, the image forming apparatus is provided with, as the main constitutional elements, an image forming control part 71 (or control part), an interface (I/F) control part 72, a receive memory 73, an editing memory 74, a panel part 75, an operation part 76, various sensors 77, a charge voltage control part 79, a light source control part 80, a development voltage control part 81, a supply voltage control part 82, a transfer voltage control part 83, a roller driving control part 84, a drum driving control part 86, a movement control part 88, a belt driving control part 90, and a fusing control part 92.

The image forming control part 71 mainly controls the entire operation of the image forming apparatus. The image forming control part 71 includes, for example, one or two or more types of control circuits such as a central processing unit (CPU).

The interface (I/F) control part 72 mainly receives information such as data transmitted from the external device to the image forming apparatus. This external device is, for example, a personal computer usable by a user of the image forming apparatus, and the information transmitted from the external device to the image forming apparatus is, for example, image data for forming an image.

The receive memory 73 mainly stores information such as data received by the image forming apparatus.

The editing memory 74 mainly stores data (edited image data) in which image data is edited. This edited image data is used, for example, to form an image in the image forming apparatus. Besides this, the editing memory 74 may store information such as parameters necessary for the operation of the image forming apparatus. The information stored in the editing memory 74 can be rewritten, for example, as necessary. The information stored in the editing memory 74 is, for example, a glass transition starting temperature TGS which will be described later. The details of this glass transition starting temperature TGS will be described later (see FIGS. 6 to 9).

The panel part 75 mainly includes a display panel and the like for displaying information necessary for a user to operate the image forming apparatus. The type of the display panel is not particularly limited, but is, for example, a liquid crystal panel. The operation part 76 mainly includes buttons and the like to be operated by a user at the time of operating the image forming apparatus.

Various sensors 77 mainly include the temperature sensor 78, etc., mentioned above. However, since the type of various sensors 77 is not particularly limited, it may include one or two or more types of sensors other than the temperature sensor 78 and other sensors such as a humidity sensor.

The charge voltage control part 79 mainly controls the voltage, etc., to be applied to the charge roller 33. The light source control part 80 mainly controls the exposure operation of the light source 38, etc.

The development voltage control part 81 mainly controls the development voltage V1 to be applied to the development roller 34, etc. Specifically, the development voltage control part 81, for example, applies the development voltage V1 to the development roller 34 to the certain degrees.

The supply voltage control part 82 mainly controls the supply voltage V2 to be applied to the supply roller 35, etc. Specifically, in addition to applying the supply voltage V2 to the supply roller 35, the supply voltage control part 82 is able to vary the supply voltage V2.

The transfer voltage control part 83 mainly controls the voltage to be applied to the primary transfer roller 45, etc.

In FIG. 3, the illustrated contents are simplified, but the image forming apparatus includes, for example, four charge voltage control parts 79 corresponding to the developing parts 30K, 30C, 30M, and 30Y. Specifically, for example, the image forming apparatus includes a charge voltage control part 79 for controlling the applied voltage of the charge roller 33 mounted on the developing part 30K, a charge voltage control part 79 for controlling the applied voltage of the charge roller 33 mounted on the developing part 30C, a charge voltage control part 79 for controlling the applied voltage of the charge roller 33 mounted on the part 30M, and a charge voltage control part 79 for controlling the applied voltage of the charge roller 33 mounted on the developing part 30Y.

The explanation about the charge voltage control part 79 can also be applied to, for example, each of the light source control part 80, the development voltage control part 81, the supply voltage control part 82, and the transfer voltage control part 83. That is, the image forming apparatus has four light source control parts 80, four development voltage control parts 81, four supply voltage control parts 82, and four transfer voltage control parts 83 corresponding to the developing parts 30K, 30C, 30M, 30Y.

The roller driving control part 84 mainly controls the rotation operation, etc., of a series of rollers such as a charge roller 33, a development roller 34, and a supply roller 35 via a roller motor 85. The drum driving control part 86 mainly controls the rotation operation, etc., of the photosensitive drum 32 via the drum motor 87. The movement control part 88 mainly controls the moving operation, etc., of the developing part 30 via the movement motor 89. The belt driving control part 90 mainly controls the moving operation, etc., of the intermediate transfer belt 41 via the belt motor 91. The fusing control part 92 mainly controls the temperature of the heater 93 based on the temperature measured by the thermistor 94 and controls the respective rotation applications, etc., of the heat application roller 51 and the pressure application roller 52 via the fuse motor 95.

The above described with respect to the charge voltage control part 79 can also be applied to the roller driving control part 84, the drum driving control part 86, and the movement control part 88. That is, the image forming apparatus includes, for example, four roller driving control parts 84, four drum driving control parts 86, and four movement control parts 88.

[Major Constituent Element Related to Correction Operation of Potential Difference ΔV]

As shown in FIG. 4, for example, the image forming apparatus is provided with, as main constituent elements related to the correction operation of the potential difference ΔV, a time measure part 96, a time judgment part 97, a temperature difference calculation part 98, a temperature difference coefficient determination part 99 which is a "first coefficient determination part" of one embodiment of the present invention, a correction amount determination part 100, and a potential difference correction part 101. The image formation control part 71, the time measure part 96, the time judgment part 97, the temperature difference calculation part 98, the temperature difference coefficient determination part 99, the correction amount determination part 100, and the potential difference correction part 101 are the "control part" of one embodiment of the present invention.

The time measure part 96 mainly measures the elapsed time E after the power source of the image forming apparatus is turned on. More specifically, the time measure part 96 measures, for example, the elapsed time E after the start of image formation. The time measure part 96 includes one or two or more types of measuring devices, such as, e.g., a timer.

The time measure part 96 can again measure the elapsed time E, for example, when the elapsed time E is reset after completing the correction operation of the later-described potential difference ΔV.

The time judgment part 97 mainly judges whether or not the elapsed time E measured by the time measure part 96 has reached the target time ES every predetermined judgment timing. This time judgment part 97 outputs a permission signal to the potential difference correction part 101 in order to allow the correction operation of the potential difference ΔV due to a potential difference correction part 101 which will be described later when it is judged that, for example, the elapsed time E has reached the target time ES.

The temperature difference calculation part 98 mainly calculates the temperature difference ΔT(=T−TGS) between the apparatus inner temperature T detected by the temperature sensor 78 and the glass transition starting temperature TGS. The details of the glass transition starting temperature TGS will be described later (see FIGS. 6 to 9).

The temperature difference coefficient determination part 99 mainly determines the temperature difference coefficient C1 corresponding to the temperature difference ΔT based on the temperature difference ΔT calculated by the temperature difference calculation part 98. Specifically, the temperature difference coefficient determination part 99 specifies the temperature difference coefficient C1 corresponding to the temperature difference ΔT based on, for example, the table data TAB1 stored in advance in the edit memory 74.

For example, as shown in FIG. 5, the table data TAB1 is data showing the correspondence relationship between the temperature difference ΔT and the temperature difference coefficient C1, and the correspondence relationship is set, for example, every toner color. The letter "K, C, M, and Y" shown in FIG. 5 represents, for example, the above-described four types of toners. Specifically, "K" represents black toner, "C" represents cyan toner, "M" represents magenta toner, and "Y" represents yellow toner. This also is applied to the table data TAB2 (see FIG. 14) and table data TAB3 (see FIG. 18) which will be described later. In FIG. 5, for example, a case is shown in which the value of the temperature difference coefficient C1 set every temperature difference ΔT is common without being dependent on the toner color. Of course, the value of the temperature difference coefficient C1 set every temperature difference ΔT may be different, for example, every toner color.

The correction amount determination part 100 determines, mainly, based on the temperature difference coefficient C1 determined by the temperature difference coefficient determination part 99, the correction amount VR related to the potential difference ΔV(=|V1−V2|) between the development voltage V1 applied to the development roller 34 by the development voltage control part 81 and the development voltage V2 applied to the supply roller 35 by the supply voltage control part 82.

$$\Delta V(=|V1-V2|) \quad \text{(eq. 1)}$$

Specifically, the correction amount determination part 100 determines an appropriate correction amount VR depending on the temperature difference ΔT, for example, by setting the value of the temperature difference coefficient C1 to the correction amount VR, see eq.1.1

$$VR=C1 \quad \text{(eq. 1.1).}$$

As described above, this correction amount VR is a voltage shift amount set so as to suppress or eliminate the influence of the fluctuation of the potential difference ΔV, taking into consideration the fluctuation factor of the potential difference ΔV due to the temperature difference ΔT.

The potential difference correction part 101 corrects the potential difference ΔV based on the correction amount VR determined by the correction amount determination part 100. Specifically, the potential difference correction part 101 can arbitrarily change, for example, the supply voltage V2 applied to the supply roller 35. In this case, the supply voltage V2 is corrected to a corrected supply voltage V2c with eq. 1.2.

$$V2c=V2+VR \quad \text{(eq. 1.2)}$$

As the potential difference correction part 101 changes the supply voltage V2, the supply voltage V2 changes with respect to the development voltage V1, so that the potential difference ΔV changes. With this, the potential difference ΔV is corrected. In this case, for example, it is corrected such that the potential difference ΔV decreases according to the change of the supply voltage V2, and more specifically, the potential difference ΔV after the change is corrected so as to be close to the potential difference ΔV before the change (initial set). In this case, it is preferable to be corrected such that the potential difference ΔV after the fluctuation coincides with the potential difference ΔV before the fluctuation.

When the development voltage V1 is consistent, the potential difference ΔV varies as the supply voltage V2 varies in accordance with the eq. 1. With the above correction, an adhesion amount of toner where ΔT≥1 is corrected to be close to an adhesion amount of toner where ΔT≤0.

<1-4. Specifying Procedure of Glass Transition Starting Temperature>

Next, the glass transition starting temperature TGS will be described.

Figure 6:
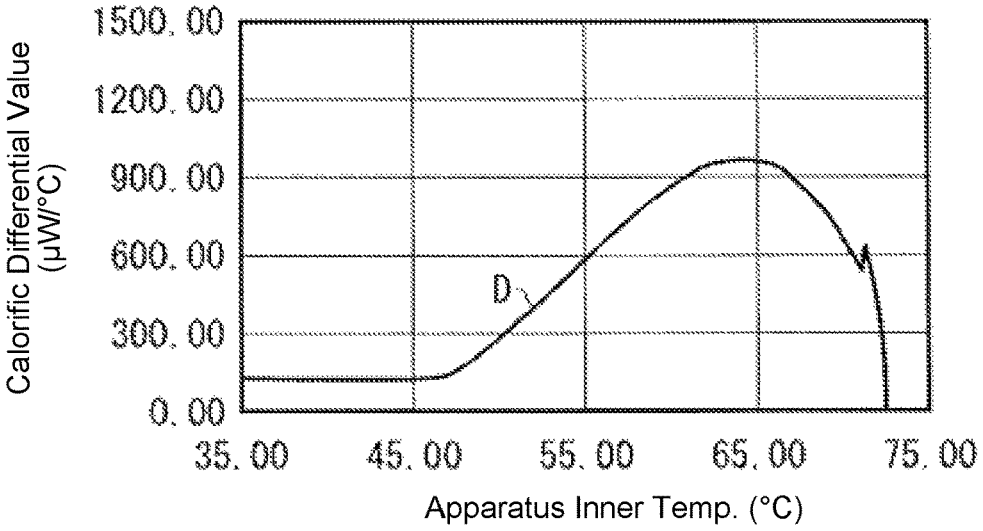
FIG. 6 shows a differential curve of a DSC curve measured using toner A in order to explain a specifying procedure of a glass transition starting temperature TGS for the toner A.
Figure 7:
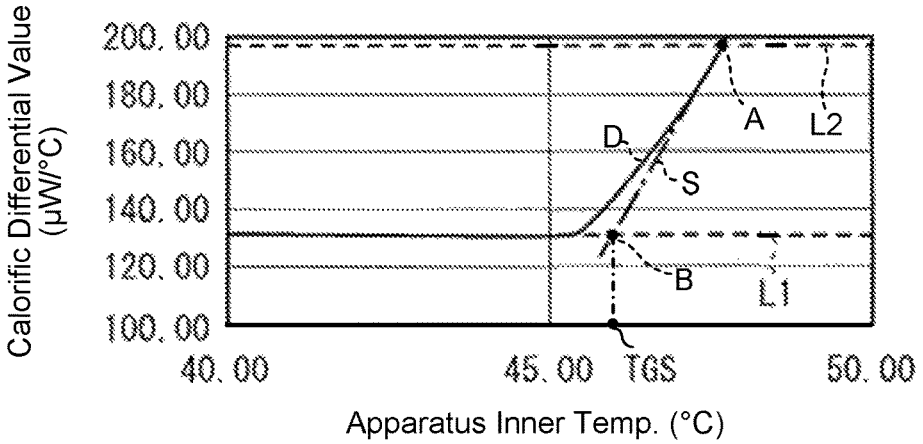
FIG. 7 is an enlarged part of the differential curve shown in FIG. 6.

FIGS. 6 and 7 each illustrate a differential curve (DDSC curve D) of the DSC curve measured using the toner A in order to explain the specifying procedure of the glass transition starting temperature TGS related to the toner A. Further, FIGS. 8 and 9 each illustrate a differential curve (DDSC curve D) of the DSC curve measured using the toner B in order to explain the specifying procedure of the glass transition starting temperature TGS related to the toner B. The DSC curve stands for a differential scanning calorimetry curve.

Figure 8:
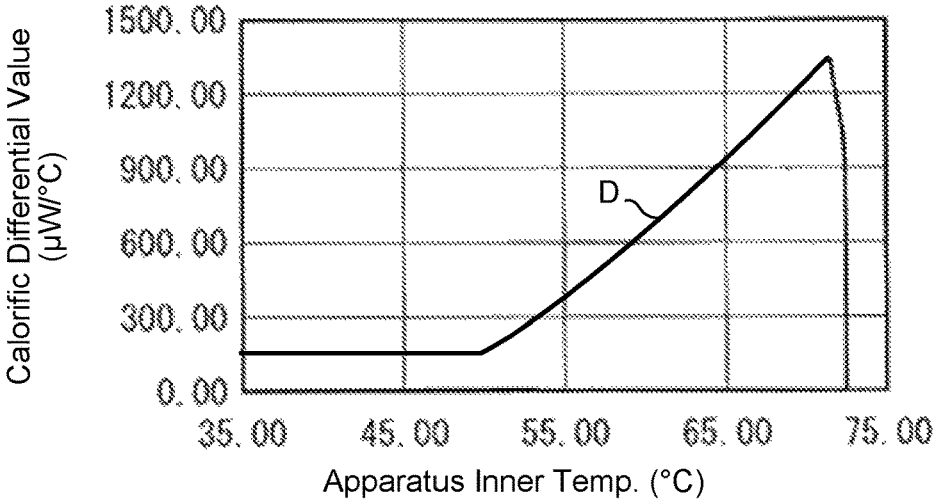
FIG. 8 shows a differential curve of a DSC curve measured using toner B in order to explain a specifying procedure of a glass transition starting temperature TGS for the toner B.
Figure 9:
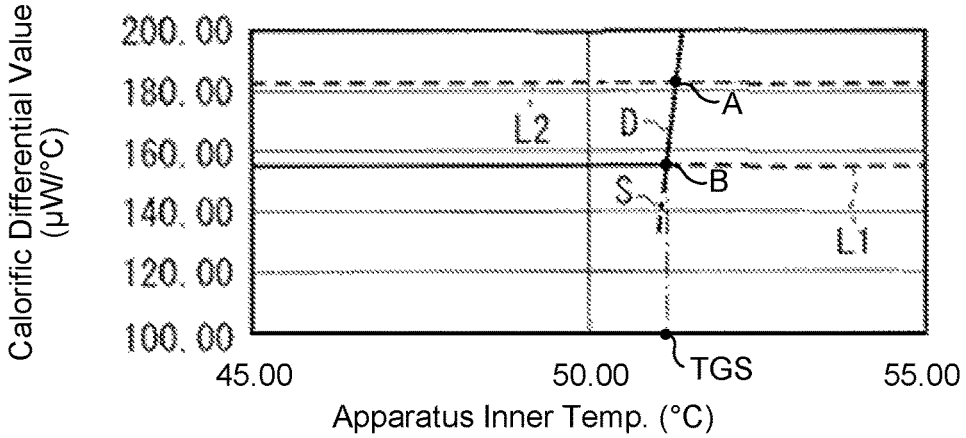
FIG. 9 is an enlarged part of the differential curve shown in FIG. 8.

Note that, in FIG. 7, a part of the DDSC curve D shown in FIG. 6 is enlarged, and in FIG. 9, a part of the DDSC curve D shown in FIG. 8 is enlarged.

The toners A and B described here have the same configuration except that the glass transition temperatures Tg are different each other due to the type of the binding agent being different. The respective configurations of the toners A and B will be described later (see Examples).

As described above, the glass transition starting temperature TGS denotes a temperature corresponding to the intersection B of a base line L1 and the glass transition start judgment tangent line S when the base line L1, a glass transition start judgment line L2, and the glass transition start judgment tangent line S are specified based on the DDSC curve D (horizontal axis: temperature (° C.), vertical axis: calorific differential value (μW/° C.)) of the toner. The base line L1 is a line along the initial DDSC curve D in which the calorific differential value is substantially constant. The glass transition start judgment line L2 is a line of a calorific differential value corresponding to 1.5 times the calorific differential value of the base line L1. The glass transition start judgment tangent line S is a tangent line that contacts the DDSC curve D at the intersection A of the DDSC curve D and the glass transition start judgment line L2.

The specifying procedure of the glass transition starting temperature TGS for the toner A is as follows.

First, by analyzing the toner A using the DSC method, a DSC curve related to the toner A is obtained. This DSC curve is a curve in which the temperature (° C.) is plotted on the horizontal axis and the calorific value (μW) is plotted on the vertical axis. The type of the analyzer used for obtaining the DSC curve is not particularly limited, but, for example, a differential scanning calorimeter EXSTAR DSC6000 manufactured by SII NanoTechnology Inc., can be exemplified.

In the case of analyzing the toner A using the DSC method, for example, the temperature of the toner A is raised from 20° C. to 200° C. at a temperature raising rate of 10° C./min and then cooled at a temperature dropping rate of 90° C./min from 200° C. to 0° C. Subsequently, for example, the temperature of the toner A is raised from 0° C. to 20° C. at a temperature raising rate of 60° C./min and then the temperature of the toner A is raised from 20° C. to 200° C. at a temperature raising rate of 10° C./min. The DSC curve described above is measured in the first temperature raising process.

Subsequently, by differentiating the calorific value on the vertical axis, a DDSC curve D is obtained as shown in FIG. 6. The DDSC curve D is a curve in which the temperature (° C.) is plotted on the horizontal axis and the calorific differential value (μW/° C.) is plotted on the vertical axis.

In the DDSC curve D shown in FIG. 6, the calorific differential value does not change as the temperature rises in the early stage, but gently increases after the middle stage as the temperature rises and thereafter gradually decreases.

Subsequently, as shown in FIG. 7, a part of the DDSC curve D shown in FIG. 6, specifically the DDSC curve D at the point where the calorific differential value begins to increase and its vicinity is enlarged. Here, for example, the range in which the temperature =40.00° C. to 50.00° C. and the calorific differential value =100.00 μW/° C. to 200.00 μW/° C. is enlarged.

Subsequently, a base line L1 is specified based on the DDSC curve D. As described above, this base line L1 is a line along the initial DDSC curve D in which the calorific differential value is substantially constant, more specifically a line obtained by extending the initial DDSC curve D. Specifically, the method of identifying the base line L1 is, for example, in accordance with JIS K7121. In FIG. 7, the base line L1 is indicated by a broken line.

Subsequently, a glass transition start judgment line L2 is specified based on the base line L1. This glass transition start judgment line L2 is a line of the calorific differential value corresponding to 1.5 times the calorific differential value of the base line L1 as described above. The reason that the calorific differential value of the glass transition start judgment line L2 is set so as to be 1.5 times the calorific differential value of the base line L1 is as follows. That is, from the experience, when the DDSC curve D for the toner A is acquired multiple times, the value obtained by multiplying the calorific differential value of each base line L1 by 1.5 is larger than the sum of the average value of the calorific differential values of a plurality of base lines L1 and three times the standard deviation of the average value thereof. Such trends are widely and generally acknowledged with respect to various types of toners including not only the toner A but the toner B also. For this reason, from the viewpoint of six sigma, which is an indicator showing the degree of variation from the average value, it is considered to be effective in identifying the glass transition starting temperature TGS so that the calorific differential value of the glass transition start judgment line L2 is set to be 1.5 times the calorific differential value of the base line L1. Here, for example, since the calorific differential value of the base line L1 is about 130.00 μW/° C., the calorific differential value of the glass transition start judgment line L2 is about 195 μW/° C. In FIG. 7, the glass transition start judgment line L2 is indicated by a broken line.

Subsequently, a glass transition start judgment tangent line S is drawn based on the DDSC curve D and the glass transition start judgment line L2. As described above, this glass transition start judgment tangent line S is a tangential line that contacts the DDSC curve D at the intersection A of the DDSC curve D and the glass transition start judgment line L2. In FIG. 7, the glass transition start judgment tangent line S is indicated by a chain line.

Finally, after identifying the intersection B of the glass transition start judgment tangent line S and the base line L1, the temperature corresponding to the intersection B is set as a glass transition starting temperature TGS. As a result, the base line L1, the glass transition start judgment line L2, the intersections A and B, and the glass transition start judgment tangent line S are specified on the basis of the DDSC curve D, so that the glass transition starting temperature TGS is specified based on the intersection B.

In the case of using the toner A (FIGS. 6 and 7), the glass transition starting temperature TGS is, for example, about 46° C.

This glass transition starting temperature TGS is a temperature (a parameter unique to the present invention) obtained from the DDSC curve D relating to the toner A, and is a reference value (threshold value) to be compared with the apparatus inner temperature T to determine the agglomerate state (or adhesion amount) of the toner used in the developing part 30. As described above, since the glass transition starting temperature TGS is lower than the glass transition temperature Tg of the actual toner A, the glass transition starting temperature TGS may be defined as a temperature that is determined just before the toner substantially begins a phase transition (or glass transition) in accordance with a rise of the apparatus inner temperature T.

The specifying procedure of the glass transition starting temperature TGS can be similarly applied even if the type of the toner is changed.

Specifically, even in cases where toner B is used instead of the toner A, the glass transition starting temperature TGS can be specified as shown in FIG. 8 and FIG. 9.

In the DDSC curve D relating to the toner B, unlike the above-mentioned DDSC curve D of the toner A, as shown in FIG. 8, the calorific differential value does not change according to the temperature rise in the early stage, but after the middle stage, it increases sharply as the temperature rises and then decreases sharply.

In this case as well, as shown in FIG. 9, by specifying the base line L1, the glass transition start judgment line L2, the intersections A and B, and the glass transition start judgment tangent line S based on the DDSC curve D, based on the intersection B, it is possible to identify the glass transition starting temperature TGS.

In the case of using the toner B (FIGS. 8 and 9), the glass transition starting temperature TGS is, for example, about 51° C.

<1-5. Configuration of Toner>

Next, the configuration of the toner will be described.

Each of yellow toner, magenta toner, cyan toner, and black toner is, for example, toner of a single component development system, more specifically negatively charged toner.

The single component development system is a system in which an appropriate charge amount is given to the toner itself without using a carrier (magnetic particle) to give an electric charge to the toner. On the other hand, the two component development system is a system in which the carrier and toner are mixed so that an appropriate charge amount is given to the developer using the friction between the carrier and the developer.

Yellow toner, for example, contains a yellow coloring agent. However, yellow toner, together with a yellow coloring agent, may contain any one or two or more types of other materials.

The yellow coloring agent includes one or two or more types of yellow pigment and yellow dye (pigment), for example. The yellow pigment is, for example, pigment yellow 74 or the like. The yellow dye is, for example, C.I. pigment yellow 74 and cadmium yellow.

The type of the other material is not particularly limited, but is, for example, a binding agent, an external additive, a release agent, and a charge control agent.

The binding agent primarily binds a yellow coloring agent, etc. The binding agent includes one or two or more types of polymer compounds, such as, e.g., a polyester based resin, a styrene-acrylic based resin, an epoxy based resin, and a styrene-butadiene based resin.

Among them, the binding agent preferably contains a polyester based resin. This is because the toner containing polyester based resin as a binding agent becomes easy to fuse to the medium since the polyester based resin has high affinity to a medium such as paper. This is also because the polyester based resin has high physical strength even when the molecular weight is relatively small, and therefore the developer including a polyester based resin has excellent durability as a binding agent.

The crystal condition of the polyester based resin is not especially limited. Therefore, the polyester based resin may be a crystalline polyester based resin, an amorphous polyester based resin, or both. Among them, it is preferable that the type of the polyester based resin be crystalline polyester. That is because yellow toner becomes more easily fusible by the medium M and the durability of the yellow toner further improves.

This polyester based resin is, for example, a reactant (condensation polymer) of one or two or more alcohols and one or two or more carboxylic acids.

The type of alcohol is not particularly limited, but among other things, it is preferable that it be a dihydric or higher alcohol and its derivative, etc. The dihydric or higher alcohol is, for example, ethylene glycol, diethylene glycol, triethylene glycol, polyethylene glycol, propylene glycol, butanediol, pentanediol, hexanediol, cyclohexanedimethanol, xylene glycol, dipropylene glycol, polypropylene glycol, bisphenol A, hydrogenated bisphenol A, bisphenol A ethylene oxide, bisphenol A propylene oxide, sorbitol, glycerin, etc.

The type of carboxylic acid is not particularly limited, but among other things it is preferable that it be a carboxylic acid having two or more valences and a derivative thereof. The dicarboxylic or higher carboxylic acid is, for example, maleic acid, fumaric acid, phthalic acid, isophthalic acid, terephthalic acid, succinic acid, adipic acid, trimellitic acid, pyromellitic acid, cyclopentanedicarboxylic acid, succinic anhydride, trimellitic anhydride, maleic anhydride, dodecenyl succinic anhydride, etc.

The external additive mainly improves the flowability of the yellow toner by suppressing agglomerate, etc., of yellow toner. The external additive includes, for example, any one or two or more types of inorganic materials, organic materials, etc. The inorganic material is, for example, a hydrophobic silica, etc. The organic material is, for example, a melamine resin, etc.

The release agent mainly improves the fusability, offset resistance, etc., of yellow tonner. The release agent includes any one or two or more types of waxes, such as, e.g., an aliphatic hydrocarbon wax, an oxide of an aliphatic hydrocarbon wax, a fatty acid ester wax, and a deoxidized product of a fatty acid ester wax. Besides this, the release agent may be, for example, a block copolymer of a series of waxes as described above.

Examples of the aliphatic hydrocarbon wax include, for example, low molecular weight polyethylene, low molecular weight polypropylene, a copolymer of olefin, a microcrystalline wax, paraffin wax, and a Fischer Tropsch wax. The oxide of the aliphatic hydrocarbon wax is, for example, an oxidized polyethylene wax. The fatty acid ester wax is, for example, a carnauba wax and a montanic acid ester wax. The deoxidized product of the fatty acid ester wax is a wax in which some or all of the fatty acid ester wax is deoxidized, such as deoxidized carnauba wax.

The charge control agent mainly controls the yellow toner's frictional charge, etc. The charge control agent used for a developer of negative charge yellow toner contains one or two or more types of, for example, azo type complex, salicylic acid type complex, calixarene type complex, etc.

Each of magenta toner, cyan toner, and black toner has the same configuration as yellow toner described above except that, for example, the type of coloring agent is different. The magenta pigment is, for example, quinacridone or the like. The cyan pigment is, for example, phthalocyanine blue (C.I. Pigment Blue 15: 3) or the like. The black pigment is, for example, carbon. The magenta dye is, for example, C.I. pigment red 238, etc. The cyan dye is, for example, a pigment blue 15: 3, etc. The black dye is, for example, carbon black, and the carbon black is, for example, furnace black and channel black.

The method of producing the toner is not particularly limited. The production method may be, for example, a pulverization method, a polymerization method, or a method other than the methods described above. Of course, the developer may be produced using two or more types of the above-described series of manufacturing methods. This polymerization method is, for example, a dissolve suspension method.

<1-6. Operation>

Next, the operation of the image forming apparatus will be explained.

Hereinafter, after describing the image forming operation, the correction operation of the potential difference ΔV will be described.

[Image Forming Operation]

In the case of forming an image on the surface of a medium M, the image forming apparatus performs, as will be described later, for example, a development process, a primary transfer process, a secondary transfer process, and a fusing process in this order, and also performs a cleaning process as the need arises. In the following explanations, FIGS. 1-3 are referred at any time.

(Development Process)

First, the medium M contained in the tray 10 is taken out by the feed roller 20. This medium M taken out by the feed roller 20 is carried along the carrying path R1 by the carrying rollers 61 and 62 in the direction of the arrow F1.

In the development process, when the photosensitive drum 32 is rotated in the developing part 30K, the charge roller 33 applies a DC voltage to the surface of the photosensitive drum 32 while rotating. As a result, the surface of the photosensitive drum 32 is uniformly charged.

Subsequently, based on the edited image data, the light source 38 irradiates light to the surface of the photosensitive drum 32. As a result, the surface potential attenuates (light attenuates) in the light irradiated part on the surface of the photosensitive drum 32, and therefore an electrostatic latent image is formed on the surface of the photosensitive drum 32.

On the other hand, in the developing part 30 K, the black toner stored in the cartridge 39 is discharged toward the supply roller 35.

After the supply voltage V2 is applied to the supply roller 35 by the supply voltage control part 82, the supply roller 35 rotates. With this, black toner is supplied from the cartridge 39 to the surface of the supply roller 35.

After the development voltage V1 is applied to the development roller 34 by the development voltage control part 81, the development roller 34 is rotated while being pressed against the supply roller 35. With this, the potential difference $\Delta V(=|V1-V2|)$ is generated, so black toner supplied to the surface of the supply roller 35 is adsorbed by the surface of the development roller 34, and the black toner is carried utilizing the rotation of the development roller 34. In this case, since a part of the developer that is being absorbed by the surface of the development roller 34 is removed by the development blade 36, the thickness of the black toner, which is absorbed by the surface of the development roller 34, is made uniform.

After the photosensitive drum 32 rotates while being pressed against the development roller 34, the black toner adsorbed on the surface of the development roller 34 is transferred to the surface of the photosensitive drum 32. With this, the black toner adheres to the surface of photosensitive drum 32 (electrostatic latent image).

[Primary Transfer Process]

In the transfer part 40, when the drive roller 42 is rotated, the driven roller 43 and the backup roller 44 rotate according to the rotation of the drive roller 42. As a result, the intermediate transfer belt 41 moves in the direction of the arrow F5.

In the primary transfer process, a voltage is applied to the primary transfer roller 45K. Since this primary transfer roller 45K is press-contacted to the photosensitive drum 32 via the intermediate transfer belt 41, the toner image of the black toner, which is attached to the surface of the photosensitive drum 32 through the above-mentioned development process, is transferred to the intermediate transfer belt 41.

Thereafter, the intermediate transfer belt 41 to which the toner image is transferred is subsequently moved in the direction of the arrow F5. As a result, in the developing parts 30C, 30M, and 30Y and the primary transfer rollers 45C, 45M, and 45Y, the development process and the primary transfer process are sequentially performed by the same procedure as the developing part 30K and the primary transfer roller 45K described above. Therefore, the cyan toner, the magenta toner, and the yellow toner are sequentially transferred to the surface of the intermediate transfer belt 41.

Specifically, the cyan toner is transferred to the surface of the intermediate transfer belt 41 by the developing part 30C and the primary transfer roller 45C. Next, the magenta toner is transferred to the surface of the intermediate transfer belt 41 by the developing part 30M and the primary transfer roller 45M. Next, the yellow toner is transferred to the surface of the intermediate transfer belt 41 by the developing part 30Y and the primary transfer roller 45Y.

Of course, whether or not the development process and the primary transfer process are actually carried out in the respective developing parts 30C, 30M, and 30Y and primary transfer rollers 45C, 45M, and 45Y depends on the color (combination of colors) required to form an image.

[Secondary Transfer Process]

The medium M carried along the carrying path R1 passes between the backup roller 44 and the secondary transfer roller 46.

In the secondary transfer process, a voltage is applied to the secondary transfer roller 46. Since the secondary transfer roller 46 is press-contacted to the backup roller 44 via the medium M, the toner image transferred to the intermediate transfer belt 41 in the above-described primary transfer process is transferred to the medium M.

[Fuse Process]

After the toner image is transferred to the medium M in the secondary transfer process, the medium M is continuously carried along the carrying path R1 in the direction of the arrow F1, and therefore it is input to the fuser 50.

In the fusing process, the surface temperature of the heat application roller 51 is controlled to be a predetermined temperature. When the pressure application roller 52 is rotated while being press-contacted to the heat application roller 51, the medium M is carried so as to pass between the heat application roller 51 and the pressure application roller 52.

As a result, the toner transferred to the surface of the medium M is heated, and therefore the toner melts. Moreover, since the melted toner is press-contacted to the medium M, the toner firmly adheres to the medium M.

Therefore, according to the edited image data, the toner is fixed so that a specific pattern is formed in a specific region on the surface of the medium M. Thus, an image is formed.

The medium M on which the image was formed is carried along the carrying path R2 in the direction of the arrow F2 by the carrying rollers 63 and 64. As a result, the medium M is ejected to the stacker part 2 from the ejection opening 1H.

The carrying procedure of the medium M is changed according to the format of the image formed on the surface of the medium M.

For example, in cases where images are formed on both sides of the medium M, the medium M that has passed through the fuser 50 is carried along the carrying paths R3 to R5 in the direction of the arrows F3 and F4 by the carrying rollers 65 to 68, and then along the carrying path R1 by the carrying rollers 61 and 62 again in the direction of the arrow F1. In this case, the direction in which the medium M is carried is controlled by the carrying path switching guides 69 and 70. As a result, the development process, the primary transfer process, the secondary transfer process, and the fusing process are performed on the back side of the medium M (the face on which no image has been formed yet).

[Cleaning Process]

In each of the developing parts 30K, 30C, 30M, and 30Y, in some cases, unnecessary toner remains on the surface of the photosensitive drum 32. The unnecessary toner is, for example, a part of toner used in the primary transfer process that was not transferred to the intermediate transfer belt 41 and remained on the surface of the photosensitive drum 32.

Therefore, in each of the developing parts 30K, 30C, 30M, and 30Y, since the photosensitive drum 32 rotates in a state in which it is press-contacted to the cleaning blade 37, the toner remaining on the surface of photosensitive drum 32 is scraped by the cleaning blade 37. As a result, the unnecessary toner is removed from the surface of the photosensitive drum 32.

Further, in the transfer part 40, in the primary transfer process, in some cases, a part of developer transferred to the surface of the intermediate transfer belt 41 is not transferred to the surface of the medium M in the secondary transfer process, and remains on the surface of the intermediate transfer belt 41.

Therefore, in the transfer part 40, when the intermediate transfer belt 41 moves in the direction of the arrow F5, the toner remaining on the surface of the intermediate transfer belt 41 is scraped by the cleaning blade 37. As a result, the unnecessary toner is removed from the surface of the intermediate transfer belt 41.

With this, the image forming operation is completed.

[Correction Operation of Potential Difference ΔV]

As will be described later, the image forming apparatus performs a correction operation of the potential difference AV as necessary while performing the image forming operation.

Figure 10:
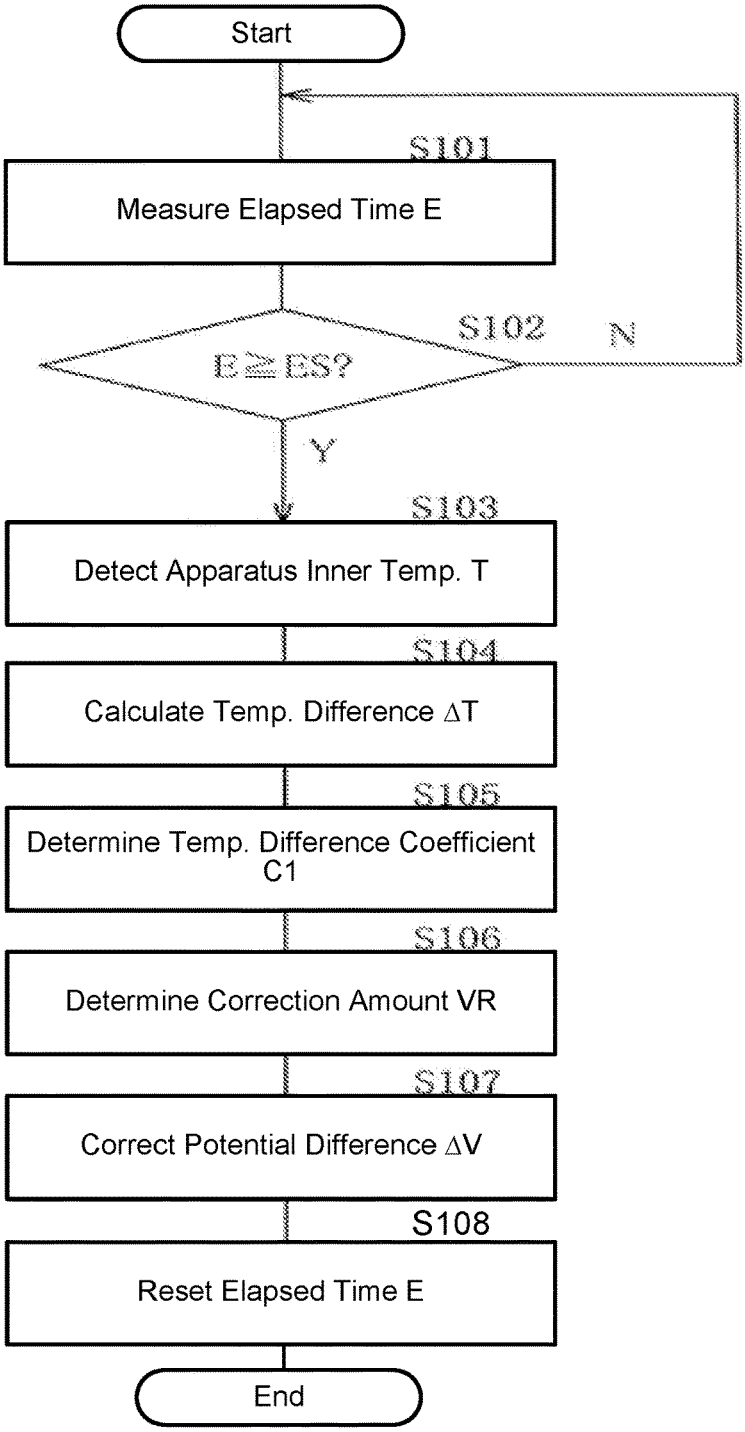
FIG. 10 is a flowchart for explaining the operation of the image forming apparatus.

FIG. 10 shows a flow for explaining the operation of the image forming apparatus. FIG. 10 shows a flow in the case in which the image forming apparatus performs a correction operation of a potential difference ΔV only once. In the following description, reference is made to FIGS. 1 to 9 as needed.

In the following, an example will be described in which the correction operation of the potential difference ΔV is performed with respect to the development part 30K accommodating black toner. Noted that the bracketed step numbers described below correspond to the step numbers shown in FIG. 10.

Before using the image forming apparatus, for the purpose of allowing the image forming apparatus to perform the potential difference operation ΔV based on the glass transition starting temperature TGS, the glass transition starting temperature TGS specified according to the type of toner (glass transition temperature Tg) is stored in the edit memory 74.

That is, when the toner A is used to form an image, the aforementioned glass transition starting temperature TGS=46° C. is registered in the edit memory 74. Further, when the toner B is used to form an image, the aforementioned glass transition starting temperature TGS=51° C. is registered in the edit memory 74.

In order to enable the selection of the temperature difference coefficient C1 based on the temperature difference AT, table data TAB1 is stored in the edit memory 74. In the table data TAB1, for example, an appropriate temperature difference coefficient C1 is predetermined every temperature difference ΔT based on the relationship between the temperature difference ΔT and the toner adhesion amount with respect to the surface of the photosensitive drum 32, etc.

When the power source of the image forming apparatus is turned on, the time measure part 96 starts the measurement of the elapsed time E. After that, as needed, an image is formed on the surface of the medium M by carrying out the image forming operation as described above. Since the image formation frequency (or the number of times for forming images) is arbitrary, it may be one time only or two or more times. In this case, as described above, since the development voltage V1 is applied to the development roller 34 by the development voltage control part 81 and the supply voltage V2 is applied to the supply roller 35 by the supply voltage control part 82, the potential difference ΔV(=|V1−V2|) has been occurred. The respective values of the development voltage V1 and the supply voltage V2 are not particularly limited. Specifically, the development voltage V1 is, for example, −200 V and the supply voltage V2 is, for example, −300 V.

When performing the correction operation of the potential difference ΔV, the time measure part 96 initially measures the elapsed time E (S101).

Subsequently, the time judgment part 97 judges whether or not the elapsed time E has reached the target time ES (S102). The target time ES is not particularly limited, but is, for example, 30 minutes.

In cases where the elapsed time E has not reached the target time ES (S102 N), it is not the timing to perform the correction operation of the potential difference ΔV yet, so the process returns to the time measurement operation of the time measure part 96 (S101).

On the other hand, in cases where the elapsed time E has reached the target time ES (S102 Y), since it is the timing to perform the correction operation of the potential difference ΔV, the temperature sensor 78 detects the apparatus inner temperature T (S103). In cases where the image forming apparatus is cooled sufficiently due to the fact that the image forming apparatus is not used or the image forming apparatus is used with low use of frequency, the apparatus inner temperature T tends to become likely to rise. On the other hand, in cases where the frequency of usage of the image forming apparatus is high and therefore the development part 30, which is continuously performing the development process, is generating heat due to frictional heat, etc., the apparatus inner temperature T tends to become likely to rise.

In this case, the time judgment part 97 outputs a permission signal to the potential difference correction part 101 in order to allow the correction operation of the potential difference ΔV due to a potential difference correction part 101 which will be described later.

Subsequently, the temperature difference calculation part 98 calculates the temperature difference ΔT(=T−TGS) between the apparatus inner temperature T and the glass transition starting temperature TGS based on the glass transition starting temperature TGS stored in the edit memory 74 (S104). In cases where the image forming apparatus is not used or the image forming apparatus is used but the frequency of usage is low, as mentioned above, the apparatus inner temperature T becomes less likely to rise, so the apparatus inner temperature T tends to become less likely to be equal to or higher than the glass transition starting temperature TGS. On the other hand, in cases where the frequency of usage of the image forming apparatus is high, the apparatus inner temperature T tends to become likely to rise as described above, so that the apparatus inner temperature T tends to become likely to be equal to or higher than the glass transition starting temperature TGS.

Subsequently, the temperature difference coefficient determination part 99 determines the temperature difference coefficient C1 corresponding to the temperature difference ΔT based on the temperature difference ΔT and the table data TAB1 stored in the edit memory 74 (S105).

Specifically, for example, in cases where the apparatus inner temperature T is lower than the glass transition starting temperature TGS and therefore the temperature difference ΔT is a negative value, the temperature difference coefficient determination part 99 selects the value (=2) corresponding to the temperature difference ΔT≤0 among the series of values corresponding to the black toner (K) in the table data TAB1 as the temperature difference coefficient C1. Also, for example, in cases where the apparatus inner temperature T is higher than the glass transition starting temperature TGS and therefore the temperature difference ΔT is a positive value (e.g., temperature difference ΔT=3), the temperature difference coefficient determination part 99 selects a value (=15) corresponding to the temperature difference ΔT=3 among a series of values corresponding to the black toner (K) in the table data TAB1 as the temperature difference coefficient C1.

The temperature difference coefficient C1 is a factor which determines the correction amount VR of the later-described potential difference ΔV. Specifically, for example, in cases where the apparatus inner temperature T is equal to or less than the glass transition starting temperature TGS (temperature difference ΔT is a negative value or 0), it is considered that the potential difference ΔV does not fluctuate due to the apparatus inner temperature T to the extent that the toner adhesion amount with respect to the photosensitive drum 32 greatly fluctuates. In this case, in order to reduce the value of the correction amount VR, the temperature difference coefficient C1 is also set to be a small value. Also, in cases where the apparatus inner temperature T is higher than the glass transition starting temperature TGS (temperature difference ΔT is a positive value), it is considered that the potential difference ΔV is fluctuating due to the apparatus inner temperature T to the extent that the toner adhesion amount with respect to the photosensitive drum 32 greatly fluctuates. In this case, in order to increase the value of the correction amount VR, the temperature difference coefficient C1 is also set to be a large value.

Subsequently, the correction amount determination part 100 determines the correction amount VR used to correct the potential difference ΔV based on the temperature difference coefficient C1 (S106).

Specifically, the correction amount determination part 100 determines the correction amount VR by, for example, setting the value of the temperature difference coefficient C1 to the value of the correction amount VR (VR=C1).

Finally, the potential difference correction part 101 corrects the potential difference ΔV based on the correction amount VR (S107). As described above, in cases where the elapsed time E has reached the target time ES, the permission signal has already been output from the time judgment part 97 to the potential difference correction part 101. Therefore, the potential difference correction part 101 can perform the correction operation of the potential difference ΔV according to the permission signal.

Specifically, for example, in the state in which a constant development voltage V1 is applied to the development roller 34, the potential difference correction part 101 changes the supply voltage V2 applied to the supply roller 35 to thereby reduce the potential difference ΔV.

In detail, as described above, in cases where the apparatus inner temperature T is higher than the glass transition starting temperature TGS (temperature difference ΔT is a positive value), the potential difference ΔV increases due to the apparatus inner temperature T. Therefore, the amount of toner supplied from the supply roller 35 to the development roller 34 tends to become likely to increase. In this case, as the amount of toner transferred from the surface (electrostatic latent image) of the development roller 34 to the electrostatic latent image (the toner adhesion amount with respect to the surface of the photosensitive drum 32) increases, the density of the image deviates from the desired density. Of course, since the increased amount of the potential difference ΔV fluctuates according to the apparatus inner temperature T, when the potential difference ΔV fluctuates according to the conversion of the apparatus inner temperature T, the density tends to become likely to vary among the images.

On the other hand, even if the potential difference ΔV increases due to the apparatus inner temperature T, by correcting the potential difference ΔV so as to become smaller, more specifically, by shifting the value of the potential difference ΔV after the fluctuation so that the value of the potential difference ΔV after the fluctuation approaches the value of an appropriate potential difference ΔV, the amount of toner supplied from the supply roller 35 to the development roller 34 becomes readily maintained. Therefore, since the toner adhesion amount becomes easily maintained, the density of the image becomes difficult to deviate from the desired density, and the density becomes less likely to vary among images.

With this, the correction operation of the potential difference ΔV is completed.

Since the apparatus inner temperature T varies with time, it is preferable that the above-mentioned correction operation of the potential difference AV be repeatedly performed. Therefore, in order to repeat the correction operation of the potential difference ΔV, it is preferable that after the potential difference correction part 101 corrects the potential difference ΔV (S107), the process returns to the measurement operation (S101) of the elapsed time E after resetting the elapsed time E (S108).

<1-7. Functions and Effects>

In the image forming apparatus of this embodiment, the glass transition starting temperature TGS is specified based on the DDSC curve D related to toner, and the potential difference ΔT is corrected based on the temperature difference ΔT(=T−TGS). Therefore, for the reasons explained below, a high quality image can be stably obtained.

As described above, the density of the image depends on the adhesion amount of the toner with respect to the surface of the photosensitive drum 32, and the potential difference ΔV which affects the adhesion amount of the toner fluctuates due to the apparatus inner temperature T. In order to suppress the fluctuation in the adhesion amount of the toner caused by the fluctuation in the potential difference ΔV, as described in the background art, it is considered to use an image forming apparatus of Comparative Example which corrects the potential difference ΔV when the apparatus inner temperature T reaches a predetermined threshold or more.

However, in the image forming apparatus of Comparative Example, since the potential difference ΔV abruptly changes with the threshold of the apparatus inner temperature T as a boundary, the density of the image changes drastically due to the abrupt change in the adhesion amount of the toner. In this case, a user of the image forming apparatus becomes likely aware of the fact that the image density has changed. Also, when the apparatus inner temperature T frequently changes around the threshold due to some factor, the density becomes likely to vary every image.

Moreover, in cases where the apparatus inner temperature T is less than the threshold value, even if the potential difference ΔV changes due to some factor, since the potential difference ΔV is not corrected, the image is continuously formed with the density deviated from the desired density.

Therefore, in the image forming apparatus of Comparative Example, not only the density of the image changes extremely, but also the density becomes easily varied, and the image is more likely to be continuously formed with the density deviated from the desired density. Therefore, it is difficult to stably obtain high quality images.

On the other hand, in the image forming apparatus of this embodiment, since the potential difference ΔV is corrected based on the temperature difference ΔT, the potential difference ΔV is corrected at every measurement of the apparatus inner temperature T.

In this case, as compared with the case in which the potential inner difference ΔV is corrected when the apparatus inner temperature T becomes equal to or higher than the threshold value, since the correction frequency of the potential difference ΔV increases, the potential difference ΔV is corrected in a stepwise manner. As a result, even if the image density changes according to the correction of the potential difference ΔV, the density gradually changes without changing extremely. In this case, a user of the image forming apparatus becomes less likely to aware of the fact that the image density has changed. In addition, it is also suppressed to continuously form an image in a state in which the density is deviated from the desired density.

Moreover, in order to correct the potential difference ΔV, since the temperature difference ΔT derived from the glass transition starting temperature TGS is taken into consideration, the potential difference ΔV is properly corrected taking into account of microscopic toner aggregate. Specifically, the glass transition starting temperature TGS is a temperature at which microscopic toner agglomeration begins to occur. As a result, at above the glass transition starting temperature TGS, since the toner state begins to change so as to be in a flowing state, the toner begins to agglomerate (soft agglomerate) microscopically and then it begins to agglomerate macroscopically. In this case, by correcting the potential difference ΔV while taking into consideration the relationship between the apparatus inner temperature T and the glass transition starting temperature TGS (temperature difference ΔT), the potential difference ΔV is corrected while taking into consideration the easiness of the toner transfer (or the hardness of the toner transfer) due to the occurrence of aggregation. Therefore, the potential difference ΔV becomes more likely to be corrected so as to obtain a more appropriate value. This improves the correction accuracy of the potential difference ΔV.

Therefore, in the image forming apparatus of the present embodiment, not only the density of the image becomes less likely to change extremely and the density becomes less likely to vary, but also it is suppressed that the image is continuously formed in a state in which the density is deviated from the desired density. Moreover, since the potential difference ΔV is corrected while taking into account the glass transition starting temperature TGS, the correction accuracy of the potential difference ΔV is fundamentally improved. As a result, a high quality image can be stably obtained.

In addition, in the image forming apparatus of this embodiment, after determining the temperature difference coefficient C1 based on the temperature difference ΔT, the correction amount VR is determined based on the temperature difference coefficient C1, and based on the correction amount VR, the potential difference ΔV is corrected. In this case, since the temperature difference ΔT (glass transition starting temperature TGS) is considered to determine the correction amount VR, the determination accuracy of the correction amount VR is improved. Therefore, a higher effect can be obtained.

Further, using the time measure part 96 and the time judgment part 97, when the elapsed time E has reached the target time ES, the correction operation of the potential difference ΔV by the potential difference correction part 101 is performed. As a result, every time the elapsed time E has reached the target time ES, the potential difference ΔV is corrected, so that compared with the case in which the difference ΔV is corrected regardless of whether or not the elapsed time E has reached the target time ES, it is possible to properly reduce the frequency of performing the correction of the potential difference ΔV. Of course, in cases where the potential difference ΔV is corrected based on the elapsed time E, it is possible to arbitrarily adjust the timing (interval) at which the potential difference ΔV is corrected by changing the elapsed time E.

Figure 11:
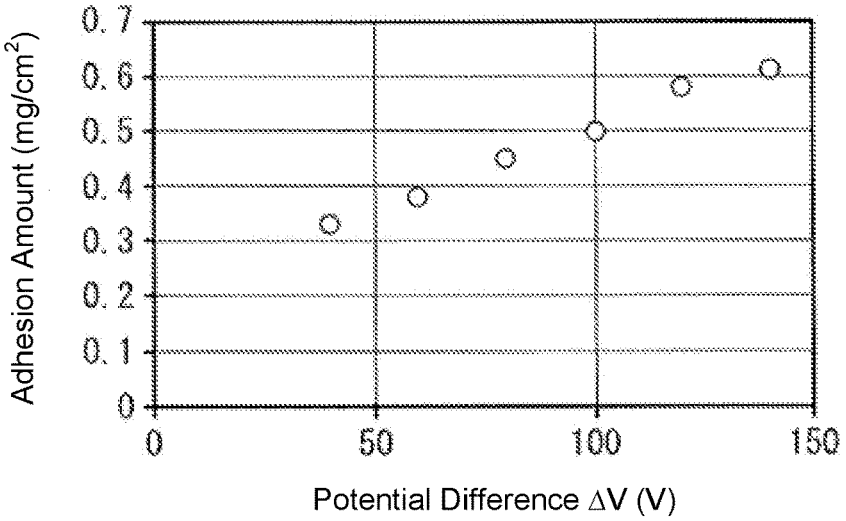
FIG. 11 is a graph showing the correlation between the potential difference ΔV and the toner adhesion amount.
Figure 12:
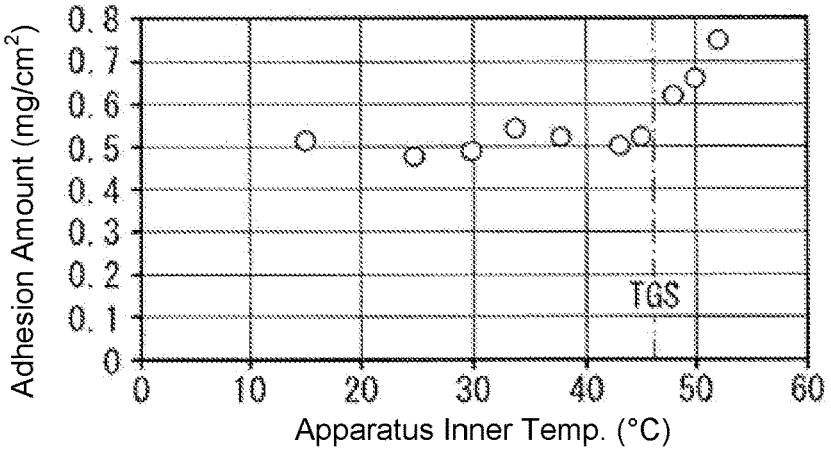
FIG. 12 is a graph showing the correlation between the apparatus inner temperature T and the toner adhesion amount.

Here, from FIGS. 11 and 12, it is apparent that the toner adhesion amount fluctuates due to the potential difference ΔV and the apparatus inner temperature T and the correction accuracy of the potential difference ΔV is improved by determining the correction amount VR while taking into consideration the apparatus inner temperature T (glass transition starting temperature TGS).

FIG. 11 shows the correlation between the potential difference ΔV(V) and the toner adhesion amount (mg/cm$^2$), and FIG. 12 shows the correlation between the apparatus inner temperature T (° C.) and the toner adhesion amount (mg/cm$^2$). In FIG. 12, the glass transition starting temperature TGS is indicated by a broken line. In order to measure the toner adhesion amount, for example, the probe (area=1 cm$^2$) is approached to the surface of the development roller 34 and a DC voltage (=300 V) is applied to the probe using a power source to thereby attach toner to the probe. Then, the adhesion amount (mg) of the toner is measured. The toner used for examining the aforementioned two correlations is, for example, the toner A.

As is apparent from FIG. 11, the toner adhesion amount varies according to the potential difference ΔV. Specifically, the toner adhesion amount increases as the potential difference ΔV increases. The result shows that image density also changes since the toner adhesion amount changes due to the change of the potential difference ΔV when the potential difference ΔV changes according to the change of the apparatus inner temperature T after the start of use of the image forming apparatus.

Also, as is apparent from FIG. 12, the toner adhesion amount varies depending on the apparatus inner temperature T. Specifically, the toner adhesion amount hardly changes in the first half, but rapidly increases in the second half as the apparatus inner temperature T increases. The result indicates as follows. After the start of use of the image forming apparatus, when the apparatus inner temperature T changes according to the repeated use of the image forming apparatus, the toner adhesion amount hardly fluctuates when the apparatus inner temperature T is relatively low. Therefore, the adhesion amount hardly fluctuates. However, when the apparatus inner temperature T is relatively high, the toner adhesion amount increases greatly, which causes a sudden change of the image density.

In particular, as is apparent from FIG. 12, the temperature at which the toner adhesion amount begins to increase rapidly approximately coincides with the glass transition starting temperature TGS. This result indicates as follows. When the apparatus inner temperature T becomes equal to or higher than the glass transition starting temperature TGS, the toner adhesion amount tends to increase due to the variation of the difference ΔV. Therefore, in order to stabilize the image density, it is necessary to control the toner adhesion amount using the correction operation of the potential difference ΔV. Based on this result, by determining the correction amount VR considering the glass transition starting temperature TGS, in cases where there is no need to positively correct the potential difference ΔV (the apparatus inner temperature T is equal to or lower than the glass transition starting temperature TGS), the correction amount VR may be set to a small value. On the other hand, in cases where it is necessary to positively correct the potential difference ΔV by determining the correction amount VR taking into consideration the glass transition starting temperature TGS (the apparatus inner temperature T is higher than the glass transition starting temperature TGS), the correction amount VR should be set to a large value.

Therefore, in the table data TAB1 shown in FIG. 5, in cases where the temperature difference ΔT is equal to or lower than 0° C., the temperature difference coefficient C1 is set so as to be a relatively small value, on the other hand, in cases where the temperature difference ΔT is higher than 0° C., the temperature difference coefficient C1 is set so as to be a relatively large value.

<2. Image Forming Apparatus (second Embodiment)>

Next, an image forming apparatus according to a second embodiment of the present invention will be described.

<2-1. Configuration>

The image forming apparatus of the present embodiment has the same configuration as the image forming apparatus of the first embodiment except that the configuration related to the correction operation of the potential difference ΔV is different and the correction procedure of the potential difference ΔV is different. In the following description, as needed, the constituent element of the image forming apparatus of the first embodiment already described will be cited.

Figures 13, 14:
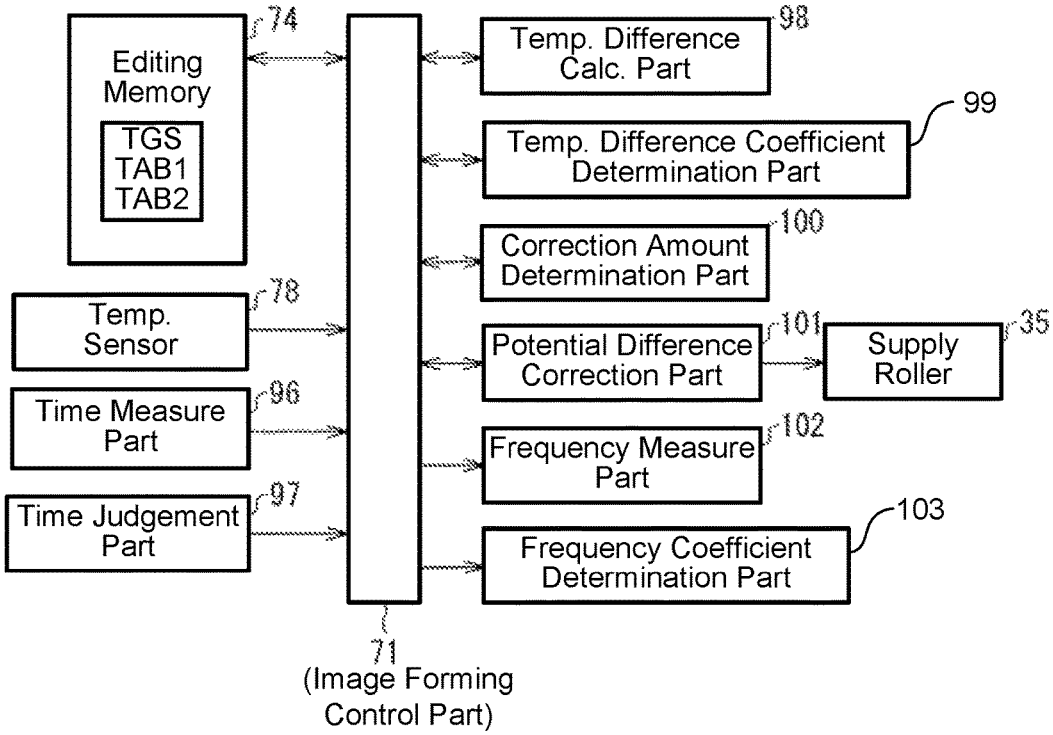
FIG. 13 is a block diagram showing a configuration of the image forming apparatus according to a second embodiment of the present invention.
FIG. 14 is a table showing table data used for determining a correction coefficient (frequency coefficient C2) based on a frequency F.

FIG. 13 shows a block configuration of the image forming apparatus, which corresponds to FIG. 4. FIG. 14 shows table data TAB2 used for determining a coefficient for correction based on the frequency F (frequency coefficient C2 which is a second correction coefficient), which corresponds to FIG. 5.

The configuration of the image forming apparatus related to the correction operation of the potential difference ΔV is the same as that of the image forming apparatus of the first embodiment (see FIG. 4) related to the correction operation of the potential difference ΔV except, for example, the configuration described below.

Specifically, as shown in FIG. 13, for example, the image forming apparatus is equipped with, as main constituent elements related to the correction operation of the potential difference ΔV, a frequency measure part 102 and a frequency coefficient determination part 103 which is a "second coefficient determination part" of the embodiment of the present invention. The image formation control part 71, the time measure part 96, the time judgment part 97, the temperature difference calculation part 98, the temperature difference coefficient determination part 99, the correction amount determination part 100, the potential difference correction part 101, the frequency measure part 102, and the frequency coefficient determination part 103 correspond a "control part" of an embodiment of the present invention.

The frequency measure part 102 mainly measures the frequency F indicating the number of times that the images have been formed using toner. The timing at which the frequency measure part 102 starts measurement of the frequency F is not particularly limited, but is, for example, immediately after the power source of the image forming apparatus is turned on and after completion of the correction operation of the potential difference ΔV. At these timings, for example, as will be described later, the frequency F is reset, so that the frequency measure part 102 starts measurement of the frequency F again.

The frequency coefficient determination part 103 mainly determines the frequency coefficient C2 corresponding to the frequency F based on the frequency F measured by the frequency measure part 102. Specifically, the frequency coefficient determination part 103 specifies the frequency coefficient C2 corresponding to the frequency F based on, for example, the table data TAB2 stored in the edit memory 74 in advance.

As shown in FIG. 14, for example, this table data TAB2 is data showing the correspondence relationship between the frequency F and the frequency coefficient C2, and the correspondence relationship is set, for example, every toner color. In FIG. 14, for example, the case is shown in which the value of the frequency coefficient C2 set every frequency F is common without depending on the toner color. Of course, the value of the frequency coefficient C2 set every frequency F may be different, for example, every toner color.

The correction amount determination part 100 mainly determines the correction amount VR based on the temperature difference coefficient C1 determined by the temperature difference coefficient determination part 99 and the frequency coefficient C2 determined by the frequency coefficient determination part 103.

Specifically, the correction amount determination part 100 calculates, for example based on the temperature difference coefficient C1 and the frequency coefficient C2, the product (=C1×C2) of the temperature difference coefficient C1 and the frequency coefficient C2 to determine the temperature difference ΔT and an appropriate correction amount VR according to the frequency F. As described above, this correction amount VR is a voltage shift amount set so as to suppress or eliminate the influence of the fluctuation of the potential difference ΔV, taking into consideration the fluctuation factor of the potential difference ΔV due to the respective temperature difference ΔT and the frequency F.

<2-2. Operation>

The operation of the image forming apparatus is the same as the operation of the image forming apparatus of the first embodiment except that, for example, the content of the correction operation of the potential difference ΔV is different. As will be described later, the image forming apparatus performs a correction operation of the potential difference ΔV as necessary while performing the image forming operation.

Figure 15:
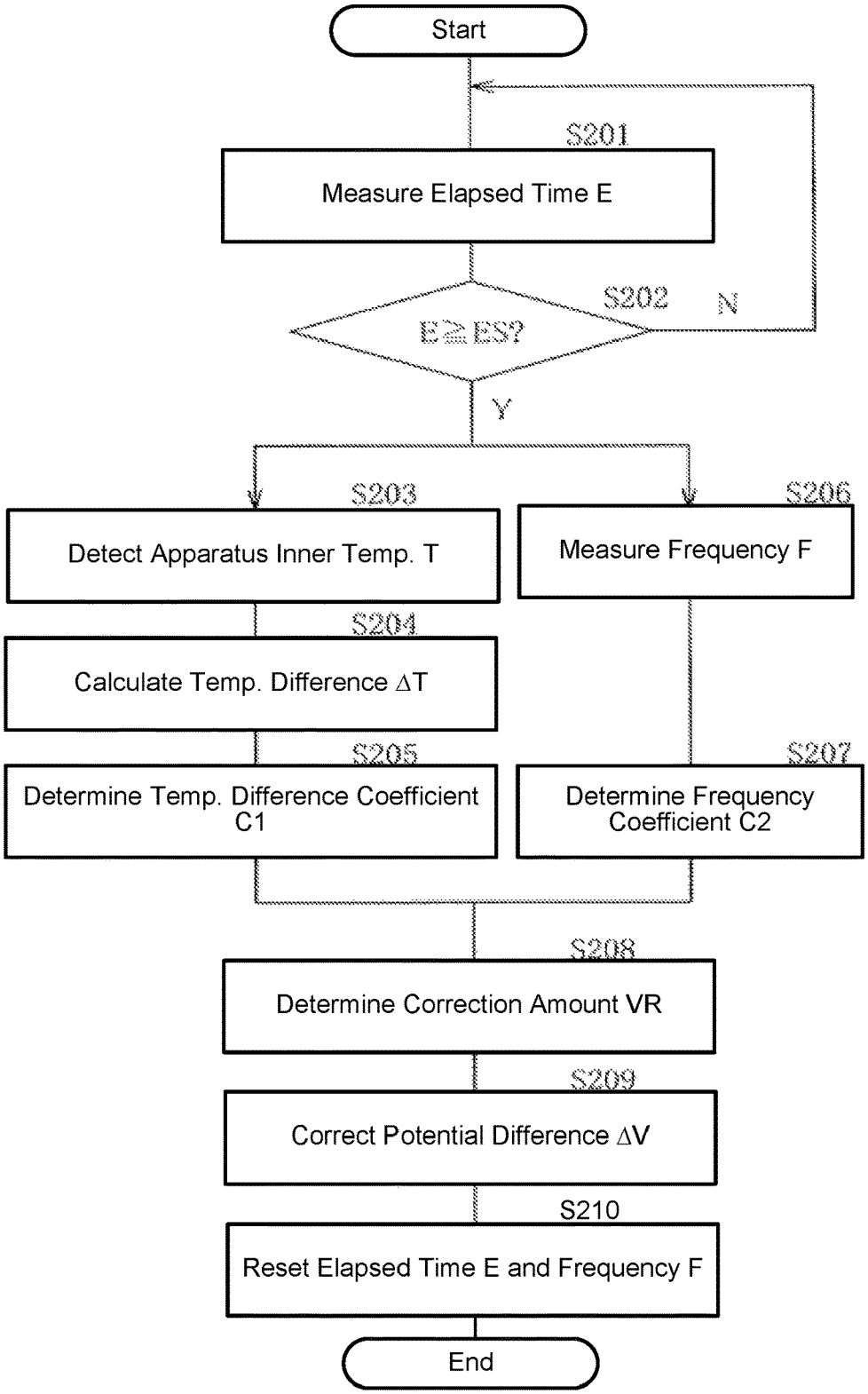
FIG. 15 is a flowchart for explaining the operation of the image forming apparatus.

FIG. 15 shows the flow for explaining the operation of the image forming apparatus, which corresponds to FIG. 10. FIG. 15 shows a flow the case in which the image forming apparatus performs a correction operation of a potential difference ΔV only once related to the development part 30K. In the following description, reference is made to FIGS. 1 to 5, and FIGS. 13 and 14 as needed. Noted that the bracketed step numbers described below correspond to the step numbers shown in FIG. 15.

Before using the image forming apparatus, for example, table data TAB2 is stored in the edit memory 74 together with the glass transition starting temperature TGS and the table data TAB1.

When the power source of the image forming apparatus is turned on, the time measure part 96 starts the measurement of the elapsed time E. After that, as needed, an image is formed on the surface of the medium M by carrying out the forming operation of the image as described above.

When performing the correction operation of the potential difference ΔV, the time measure part 96 initially measures the elapsed time E (S201). Subsequently, the time judgment part 97 judges whether or not the elapsed time E has reached the target time ES (S202).

If the elapsed time E has not reached the target time ES (S202 N), it is not the timing to perform the correction operation of the potential difference ΔV yet, so the process returns to the time measurement operation of the time measure part 96 (S201). On the other hand, when the elapsed time E has reached the target time ES (S202 Y), since it is the timing to perform the correction operation of the potential difference ΔV, the correction operation of the potential difference ΔV is carried out.

In this case, according to the operation procedure similar to that of the image forming apparatus of the first embodiment, after calculating the temperature difference ΔT based on the apparatus inner temperature T, the temperature difference coefficient C1 is determined based on the temperature difference ΔT. In other words, the temperature sensor 78 detects the apparatus inner temperature T (S203). Subsequently, the temperature difference calculation part 98 calculates the temperature difference ΔT(=T−TGS) based on the apparatus inner temperature T detected by the temperature sensor 78 and the glass transition starting temperature TGS stored in the edit memory 74 (S204). Subsequently, the temperature difference coefficient determination part 99 determines the temperature difference coefficient C1 corresponding to the temperature difference ΔT based on the temperature difference ΔT and the table data TAB1 stored in the edit memory 74 (S205).

In parallel with the operation of the determination operation of the aforementioned temperature difference coefficient C1, the frequency coefficient C2 is determined.

Specifically, the frequency measure part 102 measures the frequency F that the image was formed is measured (S206).

Subsequently, based on the frequency F measured by the frequency measure part 102 and the table data TAB2 stored in the edit memory 74, the frequency coefficient determination part 103 determines the frequency coefficient C2 corresponding to the frequency F (S207).

Specifically, for example, when the frequency F is less than 50 times, the frequency coefficient determination part 103 selects, out of a series of values corresponding to the black toner (K) in the table data TAB2, the value (=0.5) corresponding to the frequency F=up to 50 as the frequency coefficient C2. Further, for example, when the frequency F is 150 times, the frequency coefficient determination part 103 selects, out of a series of values corresponding to the black toner (K) in the table data TAB2, the value (=0.8) corresponding to the frequency F=up to 150 as the frequency coefficient C2.

The frequency coefficient C2 is a factor that determines the correction amount VR of the potential difference ΔV similarly to the aforementioned temperature difference coefficient C1. Specifically, for example, when the frequency F is small, it is considered that the potential difference ΔV does not fluctuate due to the frequency F to the extent that the toner adhesion amount with respect to the photosensitive drum 32 greatly fluctuates. In this case, in order to reduce the value of the correction amount VR, the frequency coefficient C2 is also set to be a small value. Further, when the frequency F is large, it is considered that the potential difference ΔV fluctuates due to the frequency F to the extent that the toner adhesion amount with respect to the photosensitive drum 32 greatly fluctuates. In this case, in order to increase the value of the correction amount VR, the frequency coefficient C2 is also set so as to be a large value.

Subsequently, the correction amount determination part 100 determines the correction amount VR based on the temperature difference coefficient C1 and the frequency coefficient C2 (S208). Specifically, the correction amount determination part 100 determines the correction amount VR by calculating the product (=C1×C2) of, for example, the temperature difference coefficient C1 and the frequency coefficient C2.

Finally, the potential difference correction part 101 corrects the potential difference ΔV based on the correction amount VR (S209). That is, the supply voltage control part 82 shifts the potential difference ΔV so as to be small by changing the supply voltage V2 in the case in which the development voltage V1 is constant, in response to the permission signal, as described above.

In detail, as described above, in cases where the frequency F is large, the apparatus inner temperature T is likely to rise due to the frictional heat generated inside the development part 30, so that the potential difference ΔV becomes likely to increase and the toner adhesion amount becomes likely to increase depending on the increase of the potential difference ΔV. This makes it easier for the image density to deviate from the desired density, and the density becomes likely to vary among images.

On the other hand, even if the potential difference ΔV increases due to the apparatus inner temperature T, by shifting the potential difference ΔV so as to be small, the toner adhesion amount becomes readily maintained. This makes it harder for the image density to deviate from the desired density, and the density becomes less likely to vary among images.

With this, the correction operation of the potential difference ΔV is completed.

Since the respective apparatus inner temperature T and frequency F vary with time, it is preferable that the above-mentioned correction operation of the difference ΔV be repeatedly performed. Therefore, in order to repeat the correction operation of the potential difference ΔV, it is preferable that after the potential difference correction part 101 corrects the potential difference ΔV (S209), the process return to the measurement operation (S201) of the elapsed time E after resetting the elapsed time E and the frequency F (S210).

<2-3. Functions and Effects>

In the image forming apparatus of the present embodiment, the potential difference AT is corrected based on the temperature difference ΔT and the frequency F.

In this case, in order to correct the potential difference ΔV, not only the fluctuation factor of the potential difference ΔV due to the temperature difference ΔT but also the fluctuation factor of the potential difference ΔV due to the frequency F are also taken into consideration. This improves the accuracy of the correction as compared with the case in which the potential difference ΔV is corrected based only on the temperature difference ΔT. Therefore, a higher quality image can be more stably obtained.

In particular, by determining the temperature difference coefficient C1 based on the temperature difference AT, determining the frequency coefficient C2 based on the frequency F, and then determining the correction amount VR based on the temperature difference coefficient C1 and the frequency coefficient C2, based on the correction amount VR, the potential difference ΔV is corrected. In this case, since not only the temperature difference ΔT (glass transition starting temperature TGS) but also the frequency F are taken into consideration to determine the correction amount VR, the determination accuracy of the correction amount VR is improved. Therefore, a higher effect can be obtained.

Other operations and effects related to the image forming apparatus of the present embodiment are similar to those of the image forming apparatus of the first embodiment.

Figure 16:
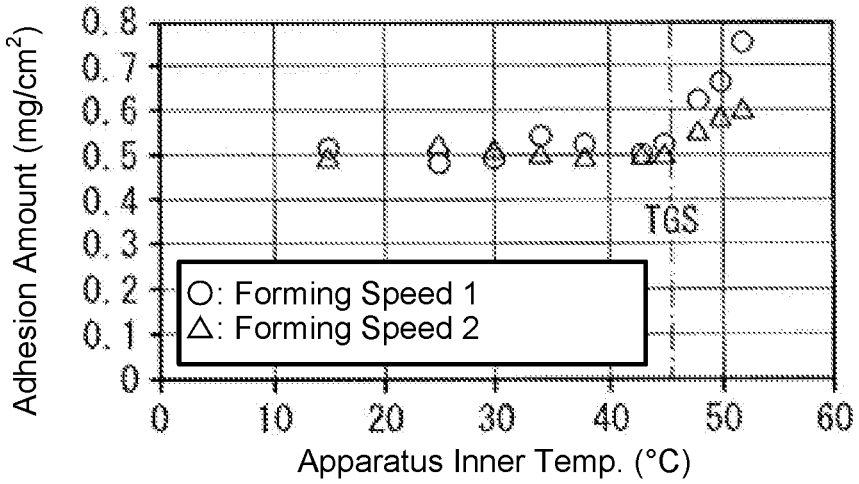
FIG. 16 is a graph showing the correlation between the apparatus inner temperature T and the toner adhesion amount when the image forming speed is changed.

Here, it is apparent from FIG. 16 that the toner adhesion amount fluctuates due to the frequency F, and the correction accuracy of the potential difference ΔV improves according to determining the correction amount VR while taking into account the frequency F.

FIG. 16 shows the correlation between the potential difference ΔV(V) and the toner adhesion amount (mg/cm$^2$) when the image forming speed is changed. In FIG. 16, the glass transition starting temperature TGS is indicated by a broken line. Here, the image forming speed is set to 200 times/30 minutes (○: forming speed 1) and 50 times/30 minutes (Δ: forming speed 2). The toner used for examining the aforementioned correlation is, for example, the toner A.

As is apparent from FIG. 16, the toner adhesion amount hardly changes in the first half, but increases sharply in the second half as the apparatus inner temperature T increases without depending on the image forming speed (in other words, the frequency F in which an image was formed per unit time). However, the tendency that the toner adhesion amount increases rapidly in the latter half becomes more pronounced when the frequency F is larger than when the frequency F is small. That is, the toner adhesion amount when the frequency F is large becomes much more likely to increase than the toner adhesion amount when the frequency F is small.

Also in this case, the temperature at which the toner adhesion amount begins to increase rapidly approximately coincides with the glass transition starting temperature TGS. Therefore, considering the results shown in FIG. 12 and FIG. 16, in cases where it is not necessary to positively correct the potential difference ΔV by determining the apparatus inner temperature T (glass transition starting temperature TGS) and the correction amount VR taking into account the frequency F (i.e., the apparatus inner temperature T is equal to or lower than the glass transition starting temperature TGS at which the frequency F is small), the correction amount VR may be set to a small value. On the other hand, in cases where it is necessary to positively correct the potential difference ΔV by determining the apparatus inner temperature T (glass transition starting temperature TGS) and the correction amount VR taking into account the frequency F (i.e., the apparatus inner temperature T is higher than the glass transition starting temperature TGS and the frequency F is small), it is required to set so that the correction amount VR becomes a larger value.

Therefore, in the table data TAB2 shown in FIG. 14, when the frequency F is small, the frequency coefficient C2 is set so as to be a relatively small value, whereas when the frequency F is large, the frequency coefficient C2 is set so as to be a relatively large value.

<3. Image Forming Apparatus (third Embodiment)>

Next, an image forming apparatus according to a third embodiment of the present invention will be described.

<3-1. Configuration>

The image forming apparatus of the present embodiment has the same configuration as the image forming apparatus of the second embodiment except that the configuration related to the correction operation of the potential difference ΔV is different and the correction procedure of the potential difference ΔV is different. In the following description, as needed, the constituent element of the image forming apparatus of the second embodiment already described is cited.

Figure 17:
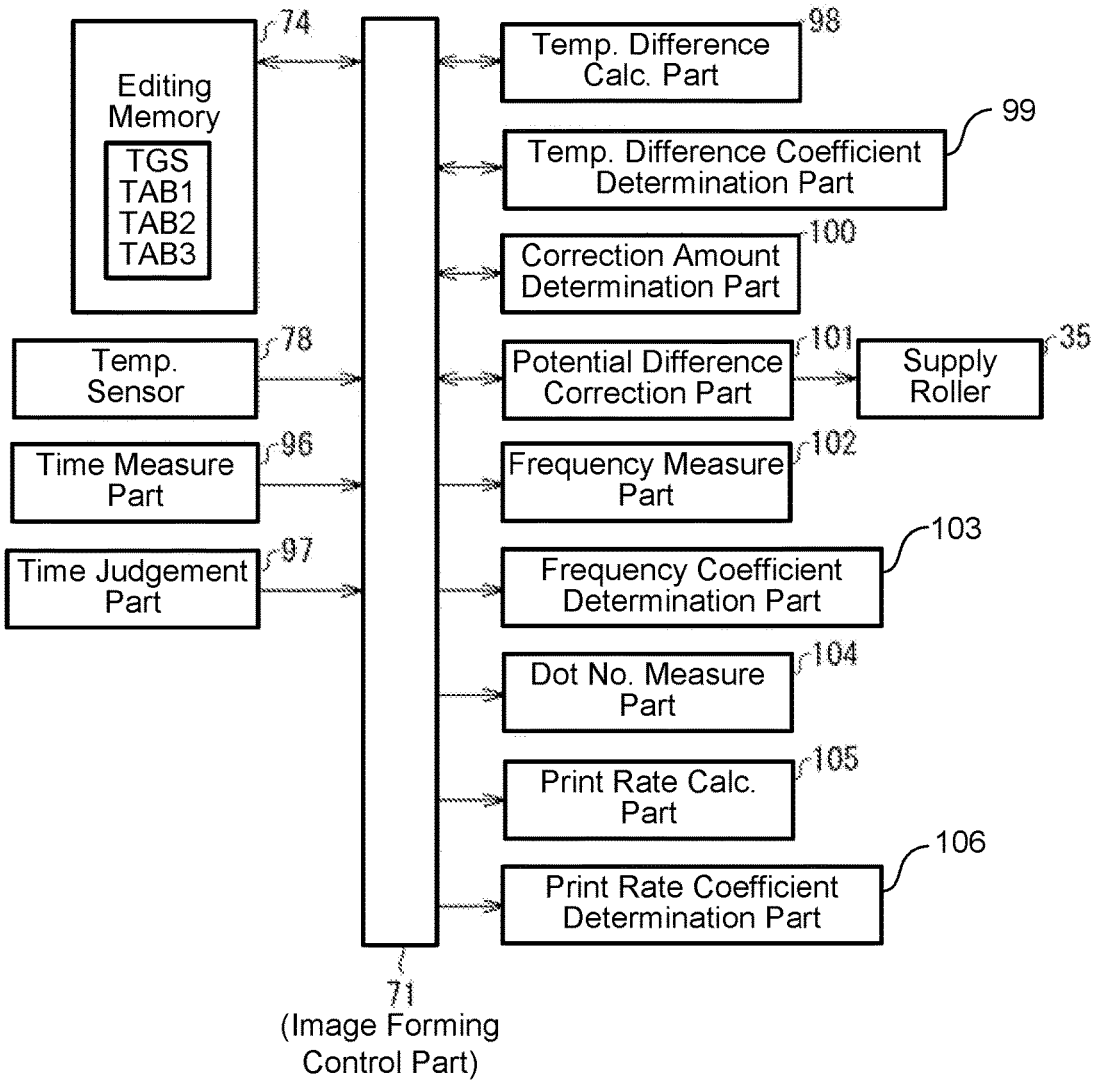
FIG. 17 is a block diagram showing the configuration of the image forming apparatus according to a third embodiment of the present invention.

FIG. 17 shows a block configuration of the image forming apparatus, which corresponds to FIG. 13. FIG. 18 shows the table data TAB3 used for determining a coefficient for correction based on the print rate R (print rate coefficient C3 which is a third correction coefficient), which corresponds to FIG. 14.

The configuration of the image forming apparatus related to the correction operation of the potential difference ΔV is the same as that of the image forming apparatus of the second embodiment (see FIG. 13) related to the correction operation of the potential difference ΔV except, for example, the configuration described below.

Specifically, for example, as shown in FIG. 17, as main constituent elements related to the correction operation of the potential difference ΔV, the image forming apparatus is further provided with a dot number measure part 104, a print rate calculation part 105, and a print rate coefficient determination part 106 which is a "third coefficient determination part" of an embodiment of the present invention. The image formation control part 71, the time measure part 96, the time judgment part 97, the temperature difference calculation part 98, the temperature difference coefficient determination part 99, the correction amount determination part 100, the potential difference correction part 101, the frequency measure part 102, the frequency coefficient determination part 103, the dot number measure part 104, the print rate calculation part 105, and the print rate coefficient determination part 106 are the "control part" of one embodiment of the present invention.

The dot number measure part 104 mainly measures the number of dots (or dot number D) accompanied with the image formation using toner. The dot number D is a value obtained by converting the image data (or the edit image data) into the number of light emissions that are emitted from dots of the light source 38. The timing at which the dot number measure part 104 starts measuring the dot number D is not particularly limited, but is, for example, immediately after the power source of the image forming apparatus is turned on and after completion of the correction operation of the potential difference ΔV. At these timings, for example, as will be described later, the dot number D is reset, so that the dot number measure part 104 starts measurement of the dot number D again.

The print rate calculation part 105 mainly calculates the print rate R based on the dot number D measured by the dot number measure part 104. More specifically, the print rate calculation part 105 calculates the print rate R (%)=(the dot number D/total dot number DA)×100 based on the total dot number DA within a predetermined area and the dot number D. The predetermined area is, for example, the area of a region of the medium M on which an image can be formed among the surface of the medium M. The total dot number DA is the number of all dots that can be used to form an image within a given area. The dot number D is the number of all the dots used to actually form an image within a predetermined area. Of course, in cases where an image is formed on a plurality of mediums M using the image forming apparatus, the print rate R is accumulated for the plurality of mediums M. The predetermined area may be, for example, an area corresponding to three revolutions of the photosensitive drum 32.

The print rate coefficient determination part 106 mainly determines the print rate coefficient C3 corresponding to the print rate R based on the print rate R calculated by the print rate calculation part 105. Specifically, the print rate coefficient determination part 106 specifies the print rate coefficient C3 corresponding to the print rate R based on, for example, the table data TAB3 stored in the edit memory 74 in advance.

As shown in FIG. 18, for example, this table data TAB3 is data showing the correspondence relationship between the print rate R and the print rate coefficient C3, and the correspondence relationship is set, for example, every toner color. In FIG. 18, for example, the case is shown in which the value of the print rate coefficient C3 set every print rate R is common without depending on the toner color. Of course, the value of the print rate coefficient C3 set every print rate R may be different, for example, every toner color.

The correction amount determination part 100 mainly determines the correction amount VR based on the temperature difference coefficient C1 determined by the temperature difference coefficient determination part 99, the frequency coefficient C2 determined by the frequency coefficient determination part 103, and the print rate coefficient C3 determined by the print rate coefficient determination part 106.

Specifically, the correction amount determination part 100 determines an appropriate correction amount VR according to the temperature difference ΔT, the frequency F, and the print rate R, for example, by calculating the product (=C1×C2×C3) of the temperature difference coefficient C1, the frequency coefficient C2, and the print rate coefficient C3 based on the temperature difference coefficient C1, the frequency coefficient C2, and the print rate coefficient C3. As described above, this correction amount VR is a voltage shift amount set so as to suppress or eliminate the influence of the fluctuation of the potential difference ΔV, taking into consideration the fluctuation factor of the potential difference ΔV caused by the respective temperature difference ΔT, frequency F, and print rate R.

<3-2. Operation>

The operation of the image forming apparatus is the same as that of the image forming apparatus of the second embodiment except that, for example, the content of the correction operation of the potential difference ΔV is different. As will be described later, the image forming apparatus performs a correction operation of the potential difference ΔV as necessary while performing the aforementioned image forming operation.

Figure 19:
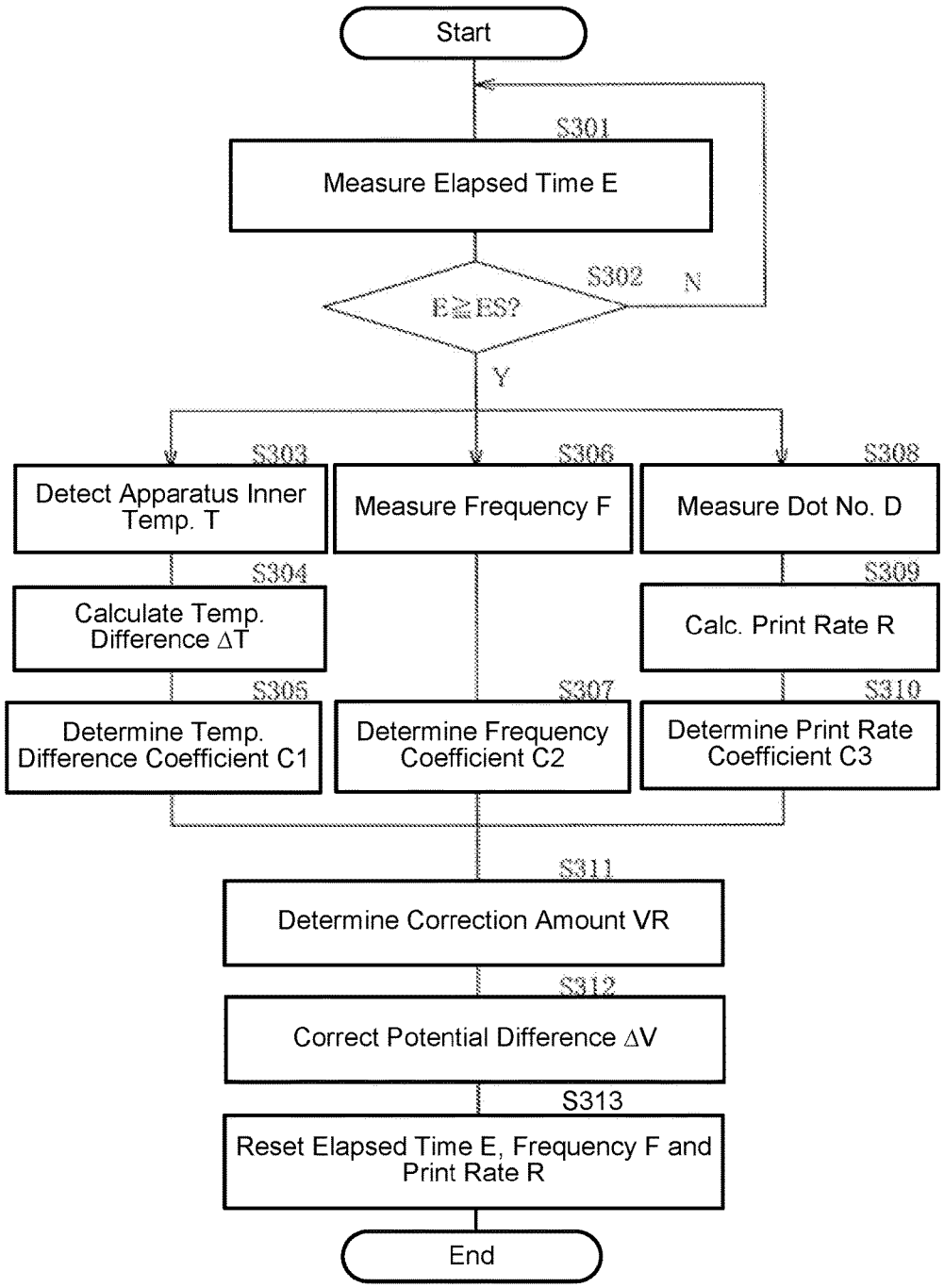
FIG. 19 is a flowchart for explaining the operation of the image forming apparatus.

FIG. 19 shows the flow for explaining the operation of the image forming apparatus, which corresponds to FIG. 15. FIG. 19 shows a flow of the case in which the image forming apparatus performs a correction operation of a potential difference ΔV only once related to the development part 30K. In the following description, reference is made to FIGS. 1 to 5, and FIGS. 17 and 18 as needed.

Before using the image forming apparatus, for example, table data TAB3 is stored in the edit memory 74 together with the glass transition starting temperature TGS and the table data TAB1 and TAB2.

When the power source of the image forming apparatus is turned on, the time measure part 96 starts the measurement of the elapsed time E. After that, as needed, an image is formed on the surface of the medium M by carrying out the forming operation of the image as described above.

When performing the correction operation of the potential difference ΔV, the time measure part 96 initially measures the elapsed time E (S301). Subsequently, the time judgment part 97 judges whether or not the elapsed time E has reached the target time ES (S302).

In cases where the elapsed time E has not reached the target time ES (S302 N), it is not the timing to perform the correction operation of the potential difference ΔV yet, so the process returns to the time measurement operation of the time measure part 96 (S301). On the other hand, when the elapsed time E has reached the target time ES (S302 Y), since it is the timing to perform the correction operation of the potential difference ΔV, the correction operation of the potential difference ΔV is carried out.

In this case, according to the operation procedure similar to that of the image forming apparatus of the first embodiment, after calculating the temperature difference ΔT based on the apparatus inner temperature T, the temperature difference coefficient C1 is determined based on the temperature difference ΔT. In other words, the temperature sensor 78 detects the apparatus inner temperature T (S303). Subsequently, the temperature difference calculation part 98 calculates the temperature difference ΔT(=T−TGS) based on the apparatus inner temperature T detected by the temperature sensor 78 and the glass transition starting temperature TGS stored in the edit memory 74 (S304). Subsequently, the temperature difference coefficient determination part 99 determines the temperature difference coefficient C1 corresponding to the temperature difference ΔT based on the temperature difference ΔT and the table data TAB1 stored in the edit memory 74 (S305).

In parallel with the determination operation of the temperature difference coefficient C1 described above, the frequency coefficient C2 is determined based on the frequency F by the same operation procedure as the image forming apparatus of the second embodiment. That is, the frequency measure part 102 measures the frequency F that the image was formed is measured (S306). Subsequently, based on the frequency F measured by the frequency measure part 102 and the table data TAB2 stored in the edit memory 74, the frequency coefficient determination part 103 determines the frequency coefficient C2 for correction corresponding to the frequency F (S307).

Further, in parallel with the determination operation of the temperature difference coefficient C1 and the determination operation of the frequency coefficient C2, the print rate coefficient C3 is determined.

Specifically, the dot number measure part 104 measures the dot number D associated with the formation of the image (S308).

Subsequently, the print rate calculation part 105 calculates the print rate R based on the dot number D measured by the dot number measure part 104 (S309).

Subsequently, the print rate coefficient determination part 106 determines the print rate coefficient C3 corresponding to the print rate R based on the print rate R calculated by the print rate calculation part 105 and the table data TAB3 stored in the edit memory 74 (S310).

Specifically, for example, when the print rate R is less than 1%, the print rate coefficient determination part 106 selects, out of a series of values corresponding to the black toner (K) in the table data TAB3, the value (=1.0) corresponding to the print rate R=up to 1 as the print rate coefficient C3. Further, for example, when the print rate R is larger than 30% and equal to or lower than 50%, the print rate coefficient determination part 106 selects, out of a series of values corresponding to the black toner (K) in the table data TAB3, the value (=0.5) corresponding to the print rate R=up to 50 as the print rate coefficient C3.

The print rate coefficient C3 is a factor that determines the correction amount VR of the potential difference ΔV similarly to the aforementioned temperature difference coefficient C1 and the frequency coefficient C2.

Specifically, for example, when the print rate R is small, it is considered that the potential difference ΔV fluctuates due to the print rate R to the extent that the toner adhesion amount with respect to the photosensitive drum 32 greatly fluctuates. This is because, due to the low toner consumption, the generation amount of the frictional heat due to the rotation of the photosensitive drum 32, etc., is increased, so that the apparatus inner temperature T is likely to rise. Under the circumstances, in order to increase the value of the correction amount VR, the print rate coefficient C3 is also set to be a large value.

Further, when the print rate R is large, it is considered that the potential difference ΔV does not fluctuate due to the frequency F to the extent that the toner adhesion amount with respect to the photosensitive drum 32 greatly fluctuates. This is because, due to the large toner consumption, the generation amount of the frictional heat due to the rotation of the photosensitive drum 32 is increased, so that the apparatus inner temperature T is less likely to rise. Under the circumstances, in order to reduce the value of the correction amount VR, the print rate coefficient C3 is also set to be a small value.

Subsequently, the correction amount determination part 100 determines the correction amount VR based on the temperature difference coefficient C1, the frequency coefficient C2, and the print rate coefficient C3 (S311). Specifically, the correction amount determination part 100 determines the correction amount VR by calculating the product (=C1×C2×C3) of, for example, the temperature difference coefficient C1, the frequency coefficient C2, and the print rate coefficient C3.

Finally, the potential difference correction part 101 corrects the potential difference ΔV based on the correction amount VR (S312). That is, the potential difference correction part 101 shifts the potential difference ΔV so as to be small by changing the supply voltage V2 in the case in which the development voltage V1 is constant as described above.

In detail, as described above, in cases where the print rate R is small, the apparatus inner temperature T is likely to rise due to the frictional heat of the photosensitive drum 32 and the medium M, so that the potential difference ΔV becomes likely to increase and the toner adhesion amount becomes likely to increase depending on the increase of the potential difference ΔV. This makes it easier for the image density to deviate from the desired density, and the density becomes likely to vary among images.

On the other hand, even if the potential difference ΔV increases due to the apparatus inner temperature T, by shifting the potential difference ΔV so as to be small, the toner adhesion amount becomes readily maintained. This makes it harder for the image density to deviate from the desired density, and the density becomes less likely to vary among images.

With this, the correction operation of the potential difference ΔV is completed.

Since the respective temperature T, frequency F, and print rate R vary with time, it is preferable that the above-mentioned correction operation of the difference ΔV be repeatedly performed. Therefore, in order to repeat the correction operation of the potential difference ΔV, it is preferable that after the potential difference correction part 101 correct the potential difference ΔV (S312), and the process return to the measurement operation (S301) of the elapsed time E after resetting the elapsed time E, the frequency F, and the print rate R (S313).

<3-3. Functions and Effects>

In the image forming apparatus of the present embodiment, the potential difference ΔT is corrected based on the temperature difference ΔT, the frequency F, and the print rate R.

In this case, in order to correct the potential difference ΔV, not only the fluctuation factor of the potential difference ΔV due to the respective temperature difference ΔT and frequency F but also the fluctuation factor of the potential difference ΔV due to the print rate R are also taken into consideration. This improves the accuracy of the correction as compared with the case in which the potential difference ΔV is corrected based only on the temperature difference ΔT and the frequency F. Therefore, a much higher quality image can be more stably obtained.

In particular, by determining the temperature difference coefficient Cl based on the temperature difference ΔT, determining the frequency coefficient C2 based on the frequency F, and then determining the correction amount VR based on the temperature difference coefficient C1, the frequency coefficient C2, and the print rate coefficient C3, the potential difference ΔV is corrected based on the correction amount VR. In this case, since not only the temperature difference ΔT (glass transition starting temperature TGS) and the frequency F but also the print rate R are taken into consideration to determine the correction amount VR, the determination accuracy of the correction amount VR is improved. Therefore, a much higher effect can be obtained.

Other operations and effects related to the image forming apparatus of the present embodiment are similar to those of the image forming apparatus of the second embodiment.

Figure 20:
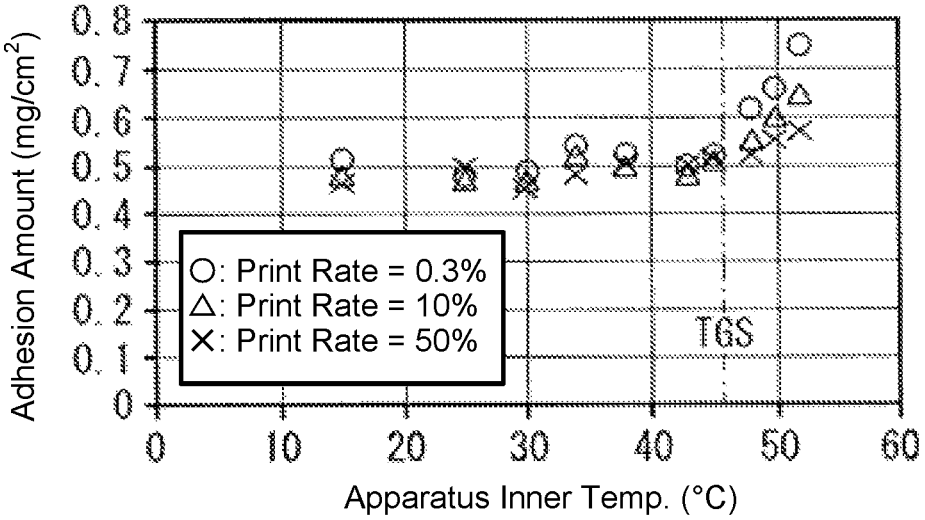
FIG. 20 is a graph showing the correlation between the apparatus inner temperature T and the toner adhesion amount when the print rate R is changed.

It is apparent from FIG. 20 that the toner adhesion amount fluctuates due to the print rate R and the correction accuracy of the potential difference ΔV improves according to determining the correction amount VR while taking the print rate R into account.

FIG. 20 shows the correlation between the potential difference ΔV(V) and the toner adhesion amount (mg/cm$^2$) when the print rate R is changed. In FIG. 20, the glass transition starting temperature TGS is indicated by a broken line. Here, the print rate R is set to 0.3%, 10%, and 50%. The toner used for examining the aforementioned correlation is, for example, the toner A.

As is apparent from FIG. 20, the toner adhesion amount hardly changes in the first half, but rapidly increases in the second half as the apparatus inner temperature T increases, without depending on the print rate R. However, the tendency that the toner adhesion amount increases rapidly in the latter half becomes more pronounced when the print rate R is smaller than when the print rate R is large. That is, the toner adhesion amount when the print rate R is small becomes much more likely to increase than the toner adhesion amount when the print rate R is large.

Also in this case, the temperature at which the toner adhesion amount begins to increase rapidly approximately coincides with the glass transition starting temperature TGS without depending on the print rate R. Therefore, based on the results shown in FIG. 12, FIG. 16, and FIG. 20, in cases where it is not necessary to positively correct the potential difference ΔV by determining the correction amount VR taking into account the apparatus inner temperature T (glass transition starting temperature TGS), the frequency F, and the print rate R (i.e., the apparatus inner temperature T is equal to or lower than the glass transition starting temperature TGS), the frequency F is small, and the print rate R is large), the frequency F is small and the print rate R is large. On the other hand, in cases where it is necessary to positively correct the potential difference ΔV (the apparatus inner temperature T is higher than the glass transition starting temperature TGS, the frequency F is large, and the print rate R is large), the correction amount VR should be set to a large value.

Therefore, in the table data TAB3 shown in FIG. 18, when the print rate R is small, the print rate coefficient C3 is set so as to be a relatively large value, whereas when the print rate R is large, the print rate coefficient C3 is set so as to be a relatively small value.

<4. Modified Example>

The composition and operation of the image forming apparatus can be changed as appropriate as described below.

Modified Example 1

Specifically, for example, in the first embodiment, the correction amount VR is determined based on the temperature difference coefficient C1, in the second embodiment, the correction amount VR is determined based on the temperature difference coefficient C1 and the frequency coefficient C2, and in the third embodiment, the correction amount VR is determined based on the temperature difference coefficient C1, the frequency coefficient C2, and the print rate coefficient C3.

Figure 21:
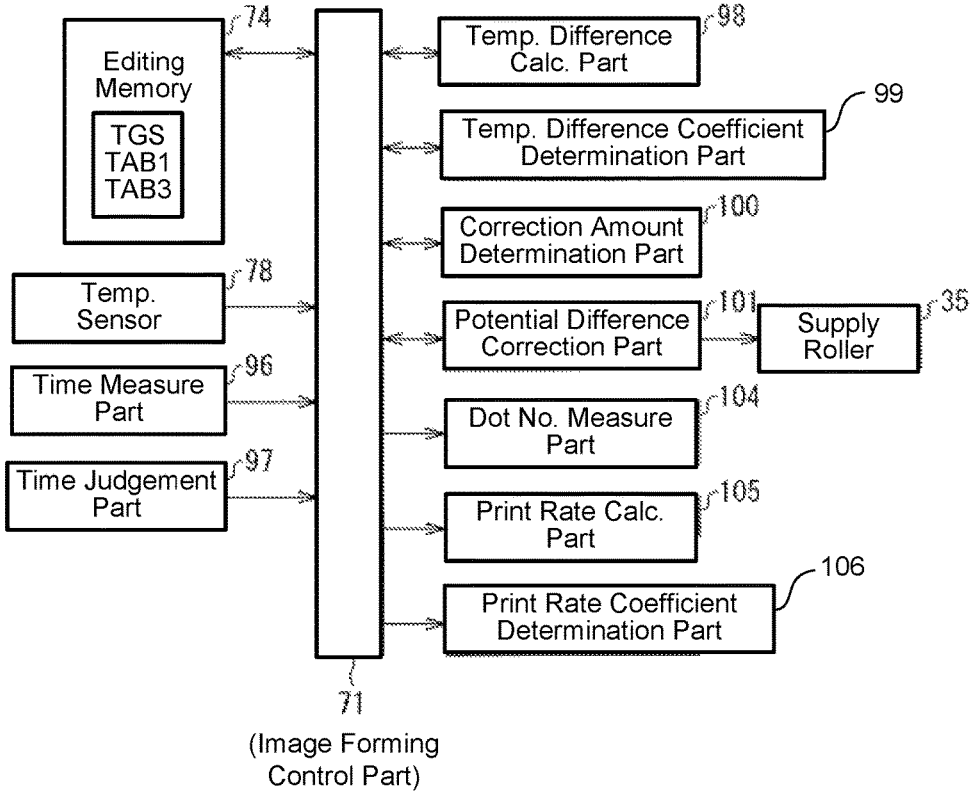
FIG. 21 is a block diagram showing a configuration of an image forming apparatus of Modified Example 1.

However, the correction amount VR may be determined based on the temperature difference coefficient C1 and the print rate coefficient C3. In this case, for example, as shown in FIG. 21 corresponding to FIGS. 4 and 17, the image forming apparatus is provided with, as major constituent elements related to the correction operation of the potential difference ΔV, the temperature difference calculation part 98, the temperature difference coefficient determination part 99, the correction amount determination part 100, the potential difference correction part 101, the dot number measure part 104, the print rate calculation part 105, and the print rate coefficient determination part 106 together with the temperature sensor 78. The image formation control part 71, the time measure part 96, the time judgment part 97, the temperature difference calculation part 98, the temperature difference coefficient determination part 99, the correction amount determination part 100, the potential difference correction part 101, the dot number measure part 104, the print rate calculation part 105, and the print rate coefficient determination part 106 correspond to the "control part" of one embodiment of the present invention.

The configuration of the image forming apparatus other than this is the same as that of the image forming apparatus shown in each of the first embodiment and the third embodiment.

Figure 22:
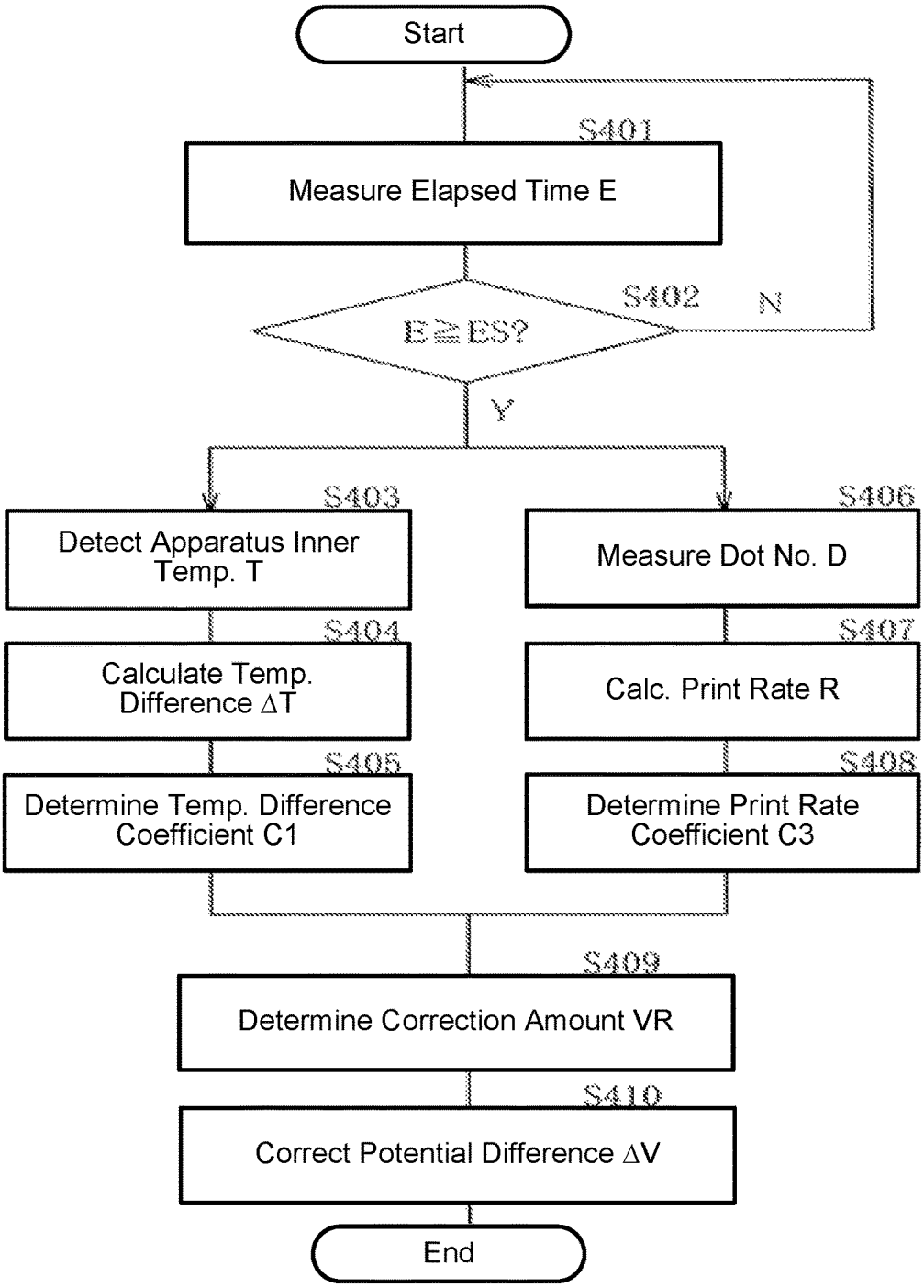
FIG. 22 is a flowchart for explaining the operation of the image forming apparatus shown in FIG. 21.

In this case, as shown in FIG. 22 corresponding to FIGS. 10 and 19, the image forming apparatus performs measurement and judgement of the elapsed time E (Steps S401, S402), first, according to the operation procedure described in the first embodiment, a determination operation of the temperature difference coefficient C1 is performed (Steps S403 to S405), and according to the operation procedure described in the third embodiment, a determination operation of the print rate coefficient C3 is performed (Steps S406 to S 408). Subsequently, the correction amount determination part 100 determines the correction amount VR based on the temperature difference coefficient C1 and the print rate coefficient C3 (S409), and the potential difference correction part 101 corrects the potential difference ΔV based on the correction amount VR (S410). Specifically, the correction amount determination part 100 determines the correction amount VR by calculating the product (=C1×C3) of, for example, the temperature difference coefficient C1 and the print rate coefficient C3.

The operation of the image forming apparatus other than this is the same as that of the image forming apparatus shown in each of the first embodiment and the third embodiment.

In this case, in order to correct the potential difference ΔV, not only the fluctuation factor of the potential difference ΔV due to the temperature difference ΔT but also the fluctuation factor of the potential difference ΔV due to the print rate R are also taken into consideration. This improves the accuracy of the correction as compared with the case in which the potential difference ΔV is corrected based only on the temperature difference ΔT. Therefore, a much higher quality image can be more stably obtained.

Modified Example 2

Further, for example, in the first to third embodiments, using the time measure part 96 and the time judgment part 97, when the elapsed time E has reached the target time ES, the correction operation of the potential difference ΔV by the potential difference correction part 101 is performed.

Further, without using the time measure part 96 and the time judgment part 97, regardless of the elapsed time E, the correction operation of the potential difference ΔV by the potential difference correction part 101 is performed. Also in this case, since the correction accuracy, etc., of the potential difference ΔV is improved, the same effect can be obtained.

However, as described above, in order to reduce the frequency that the correction operation of the potential difference ΔV is performed, it is preferable to perform a correction operation of a potential difference ΔV by the potential difference correction part 101 while judging whether or not the elapsed time E has reached the target time ES by using the time measure part 96 and the time judgment part 97.

Modified Example 3

Further, for example, in the first to third embodiments, the temperature of the transfer part 40 (intermediate transfer belt 41) is measured as the apparatus inner temperature T. However, the installation location of the temperature sensor 78 can be arbitrarily changed.

Figure 23:
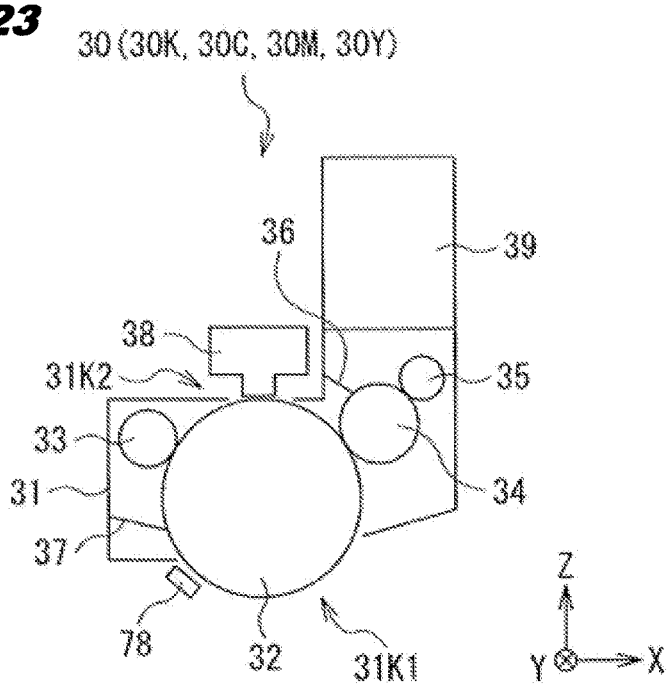
FIG. 23 is a plan view showing a configuration of an image forming apparatus of Modified Example 3.
Figure 24:
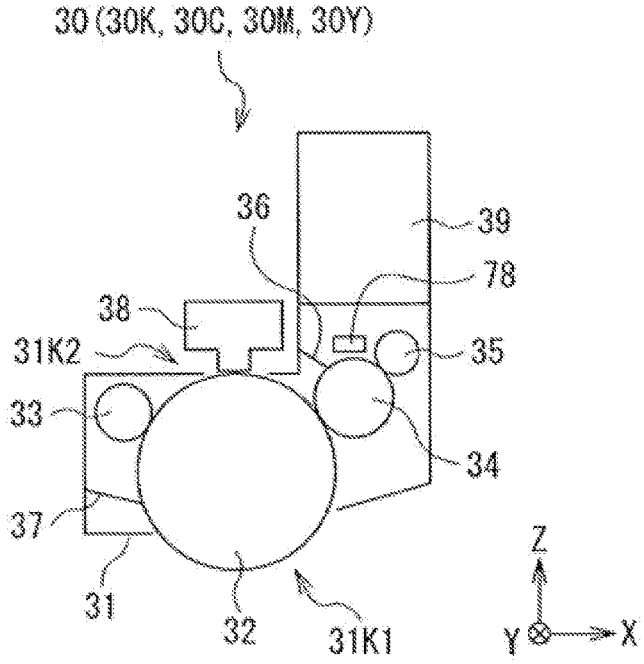
FIG. 24 is a plan view showing another configuration of the image forming apparatus of Modified Example 3.
Figure 25:
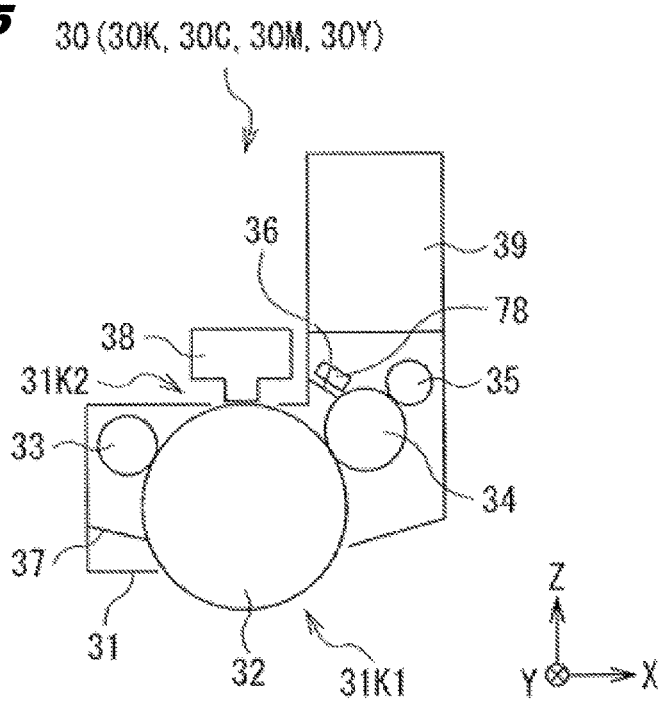
FIG. 25 is a plan view showing still another configuration of the image forming apparatus of Modified Example 3.
Figure 26:
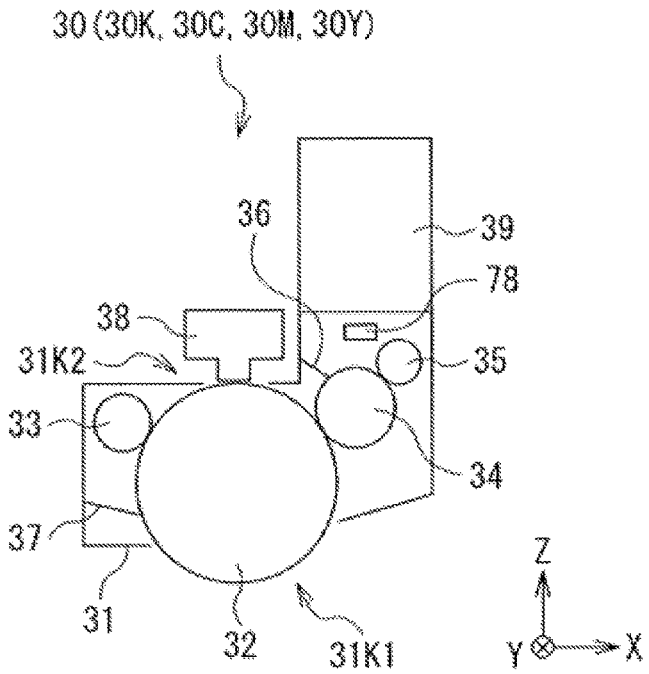
FIG. 26 is a plan view showing still yet another configuration of the image forming apparatus of Modified Example 3.

Specifically, for example, as shown in FIGS. 23 to 26 corresponding to FIG. 2, the installation location of the temperature sensor 78 may be changed. In this case, for example, as shown in FIG. 23, by setting a temperature sensor 78 in the vicinity of the photosensitive drum 32, the temperature of the photosensitive drum 32 may be detected as the apparatus inner temperature T. For example, as shown in FIG. 24, by setting the temperature sensor 78 in the vicinity of the development roller 34, the temperature of the development roller 34 may be detected as the apparatus inner temperature T. For example, as shown in FIG. 25, by setting the temperature sensor 78 in the vicinity of the development roller 34, the temperature of the development blade 36 may be detected as the apparatus inner temperature T. For example, as shown in FIG. 26, by setting the temperature sensor 78 in the space provided in the housing 31, the temperature of the space may be detected as the apparatus inner temperature T. Among them, as is apparent from correcting the difference ΔV, the temperature in the vicinity of the development roller 34 greatly affects the potential difference ΔV. Therefore, it is preferable that the location of the temperature sensor 78 be as close as possible to the development roller 34.

Even in these cases, the same effects can be obtained because the potential difference ΔV is corrected based on the apparatus inner temperature T (temperature difference ΔT).

Modified Example 4

Further, for example, as described with reference to FIGS. 6 to 9, the temperature corresponding to the intersection B (hereinafter referred to as the "intersection temperature") is set to the glass transition starting temperature TGS, but the glass transition starting temperature TGS may be intentionally shifted with respect to the intersection temperature. Considering conditions and operation status of the apparatus, the glass transition starting temperature TGS may be determined within 5% range of the intersection B.

In this case, the glass transition starting temperature TGS may be set to be higher than the intersection temperature, or the glass transition starting temperature TGS may be set to be lower than the intersection temperature. In particular, it is preferable to lower the glass transition starting temperature TGS than the intersection temperature. In the temperature range higher than the intersection temperature, as described above, the toner becomes likely to microscopically agglomerate. Therefore, in order to suppress the influence due to the toner agglomerate, it is preferable to set the glass transition starting temperature TGS so as to be lower than the intersection temperature. That is, by setting the glass transition starting temperature TGS so that it is lower than the intersection temperature, the potential difference ΔV is corrected in the temperature region where the toner is not easily agglomerated microscopically, so the accuracy of the correct can be guaranteed.

However, when setting the glass transition starting temperature TGS so as to be lower than the intersection temperature, if the glass transition starting temperature TGS is set too low, there is a possibility that the frequency of correcting the potential difference ΔV is increased. Therefore, when setting the glass transition starting temperature TGS to be lower than the intersection temperature, for example, it is preferable to set the glass transition starting temperature TGS so that the intersection temperature becomes −1° C., it is more preferable to set the glass transition starting temperature TGS so that the intersection temperature is −0.5° C., and it is still more preferable to set the glass transition starting temperature TGS so that the intersection temperature is −0.1° C. This is because it is possible to effectively correct its potential difference ΔV while suppressing the frequency at which the potential difference ΔV is corrected to a small value.

Modified Example 5

In the case shown in FIG. 4, in order to perform the correction operation of the potential difference ΔV, together with the image formation control part 71, the time measure part 96, the time judgment part 97, the temperature difference calculation part 98, the temperature difference coefficient determination part 99, the correction amount determination part 100, and the potential difference correction part 101 are used.

However, without using one or two or more of the time measure part 96, the time judgment part 97, the temperature difference calculation part 98, the temperature difference coefficient determination part 99, the correction amount determination part 100, and the potential difference correction part 101, the image formation control part 71 may also serve as one or two or more functions of the time measure part 96, the time judgment part 97, the temperature difference calculation part 98, the temperature difference coefficient determination part 99, the correction amount determination part 100, and the potential difference correction part 101. Even in this case, the same effects can be obtained.

In the case shown in FIG. 13, in order to perform the correction operation of the potential difference ΔV, together with the image formation control part 71, the time measure part 96, the time judgment part 97, the temperature difference calculation part 98, the temperature difference coefficient determination part 99, the correction amount determination part 100, the potential difference correction part 101, the frequency measure part 102, and the frequency coefficient determination part 103 are used.

However, without using one or two or more of the time measure part 96, the time judgment part 97, the temperature difference calculation part 98, the temperature difference coefficient determination part 99, the correction amount determination part 100, the potential difference correction part 101, the frequency measure part 102, and the frequency coefficient determination part 103, the image formation control part 71 may also serve as one or two or more functions of the time measure part 96, the time judgment part 97, the temperature difference calculation part 98, the temperature difference coefficient determination part 99, the correction amount determination part 100, the potential difference correction part 101, the frequency measure part 102, and the frequency coefficient determination part 103.

In the case shown in FIG. 17, in order to perform the correction operation of the potential difference ΔV, together with the image formation control part 71, the time measure part 96, the time judgment part 97, the temperature difference calculation part 98, the temperature difference coefficient determination part 99, the correction amount determination part 100, the potential difference correction part 101, the frequency measure part 102, the frequency coefficient determination part 103, the dot number measure part 104, the print rate calculation part 105, and the print rate coefficient determination part 106 are used.

However, without using one or two or more of the time measure part 96, the time judgment part 97, the temperature difference calculation part 98, the temperature difference coefficient determination part 99, the correction amount determination part 100, the potential difference correction part 101, the frequency measure part 102, the frequency coefficient determination part 103, the dot number measure part 104, the print rate calculation part 105, and the print rate coefficient determination part 106, the image formation control part 71 may also serve as one or two or more functions of the time measure part 96, the time judgment part 97, the temperature difference calculation part 98, the temperature difference coefficient determination part 99, the correction amount determination part 100, the potential difference correction part 101, the frequency measure part 102, the frequency coefficient determination part 103, the dot number measure part 104, the print rate calculation part 105, and the print rate coefficient determination part 106.

In the case shown in FIG. 21, in order to perform the correction operation of the potential difference ΔV, together with the image formation control part 71, the time measure part 96, the time judgment part 97, the temperature difference calculation part 98, the temperature difference coefficient determination part 99, the correction amount determination part 100, the potential difference correction part 101, the dot number measure part 104, the print rate calculation part 105, and the print rate coefficient determination part 106 are used.

However, without using one or two or more of the time measure part 96, the time judgment part 97, the temperature difference calculation part 98, the temperature difference coefficient determination part 99, the correction amount determination part 100, the potential difference correction part 101, the dot number measure part 104, the print rate calculation part 105, and the print rate coefficient determination part 106, the image formation control part 71 may also serve as one or two or more functions of the time measure part 96, the time judgment part 97, the temperature difference calculation part 98, the temperature difference coefficient determination part 99, the correction amount determination part 100, the potential difference correction part 101, the dot number measure part 104, the print rate calculation part 105, and the print rate coefficient determination part 106.

Although the present invention has been described with reference to one embodiment, the present invention is not limited to the manner described in the above embodiment, and various modifications can be made.

Specifically, for example, the image forming system of the image forming apparatus according to an embodiment of the present invention is not limited to an intermediate transfer system using an intermediate transfer belt, but may be another image forming system. Other image forming methods include, for example, an image forming method not using an intermediate transfer belt. In the image forming system not using an intermediate transfer belt, the toner adhered to the latent image is not indirectly transferred to the medium via the intermediate transfer belt, and the toner adhered to the latent image is directly transferred to the medium.

Further, for example, the image forming apparatus according to an embodiment of the present invention is not limited to a printer, and may be a copying machine, a facsimile machine, a multifunction machine, or the like.

The above coefficients C1 to C3 are to be independently set for each of the colors. The coefficients may be determined in correspondence with their locations. For example, among Colors KYMC of which cartridges are positioned along the movement path of the intermediate transfer belt 41, the one at the downstream is more susceptible to heat. That is because such a toner is positioned closer to the fuser 50 than others. Accordingly, the coefficients may increase and/or a variation ratio of the coefficients may become larger when the cartridge of the toner is positioned at farther downstream (or close to the fuser). When four cartridges of KCMY are arranged in that order (K is the closest to the fuser and Y is the farthest), coefficient of toner K may be set the largest among others. Coefficient of toner Y may be set the smallest among others.

What is claimed is:

1. An image forming apparatus, comprising:

a development part that includes a developer carrier to which a development voltage (V1) is applied and a supply member to which a supply voltage (V2) is applied, the supply member supplying toner on a surface of the developer carrier;

a temperature detection part that detects an apparatus inner temperature that is measured inside or near the developer carrier; and a control part that corrects a potential difference (ΔV) between the development voltage and the supply voltage based on a temperature difference (ΔT), wherein the potential difference is an absolute value determined by:

$$\Delta V = |(\text{the development voltage}) - (\text{the supply voltage})|$$

the temperature difference is determined by:

$$\Delta T = (\text{the apparatus inner temperature}) - (\text{a glass transition starting temperature}),$$

the glass transition starting temperature is defined as a temperature corresponding to an intersection between a base line and a glass transition start judgment tangent line, which are specified based on a differential curve of a differential scanning calorimetry (DSC) curve of the toner measured using a DSC method, herein the horizontal axis of the DSC curve: temperature (° C.), the vertical axis of the DSC curve: calorific differential value (μW/° C.), the base line is a line along an initial section of the DSC curve in which the calorific differential value is approximately constant with respect to the calorific differential value, the glass transition start judgment tangent line is a tangent line which is in contact with the differential curve at an intersection between the differential curve and a glass transition start judgment line that is a line of which the calorific differential values are 1.5 times greater than those of the base line.

2. The image forming apparatus according to claim 1, further comprising:

a development voltage control part that applies the development voltage to the developer carrier; and a supply voltage control part that applies the supply voltage to the supply member.

3. The image forming apparatus according to claim 1, wherein the control part includes a temperature difference calculation part that calculates the temperature difference.

4. The image forming apparatus according to claim 3, wherein the control part includes a first coefficient determination part that determines a first correction coefficient (C1) based on the temperature difference.

5. The image forming apparatus according to claim 4, wherein the control part includes a correction amount determination part that determines a correction amount (VR) to correct the potential difference based on the first correction coefficient.

6. The image forming apparatus according to claim 5, wherein the control part includes a potential difference correction part that corrects the potential difference based on the correction amount.

7. The image forming apparatus according to claim 6, wherein the control part further includes a frequency measure part that measures a frequency indicating how many times images have been formed using the toner, and a second coefficient determination part that determine a second correction coefficient (C2) based on the frequency, wherein the control part determines the correction amount based on the second correction coefficient in addition to the first correction coefficient.

8. The image forming apparatus according to claim 6, wherein the control part further includes a dot number measure part that measures the dot number associated with formation of an image using the toner, a print rate calculation part that calculates a print rate based on the dot number, and a third coefficient determination part that determines a third correction coefficient (C3) based on the print rate, wherein the control part determines the correction amount based on the third correction coefficient in addition to the first correction coefficient.

9. The image forming apparatus according to claim 6, wherein the control part further includes a frequency measure part that measures a frequency indicating how many times images have been formed using the toner, and a second coefficient determination part that determine a second correction coefficient (C2) based on the frequency, a dot number measure part that measures the dot number associated with formation of an image using the toner, a print rate calculation part that calculates a print rate based on the dot number, and a third coefficient determination part that determines a third correction coefficient (C3) based on the print rate, and the control part determines the correction amount based on the second correction coefficient and the third correction coefficient in addition to the first correction coefficient.

10. The image forming apparatus according to claim 5, further comprising:

an editing memory that stores a coefficient table for determining the first correction coefficient in which the temperature difference is segmented by several groups, one of which is zero or less, the remaining of which are more than zero, and each of the groups including the first correction coefficient, in case where the temperature difference is zero or less, the correction coefficient is substantially constant regardless of an amount of the temperature difference, in case where the temperature difference is more than zero, the correction coefficient increases as the temperature difference increases.

11. The image forming apparatus according to claim 3, wherein the control part causes the development voltage control part to increase the development voltage applied to the developer member by the correction amount such that the potential difference becomes smaller.

12. The image forming apparatus according to claim 3, wherein the control part causes the supply voltage control part to decrease the development voltage applied to the supply member by the correction amount such that the potential difference becomes smaller.

13. The image forming apparatus according to claim 1, further comprising a transfer part that transfers the toner to a medium, wherein the apparatus inner temperature is a temperature of the transfer part.

14. The image forming apparatus according to claim 1, wherein the apparatus inner temperature is a temperature of the developer carrier.

15. The image forming apparatus according to claim 1, wherein the apparatus inner temperature is a temperature that is measured inside the development part.

16. The image forming apparatus according to claim 1, wherein the control part further includes a time measure part that measures an elapsed time that is determined after a formation of the image using the toner begins, and a time judgment part that judges whether or not the elapsed time has reached a target time, wherein the control part corrects the potential difference when the elapsed time has reached the target time.

* * * * *